US010829293B2

(12) United States Patent
Kase

(10) Patent No.: US 10,829,293 B2
(45) Date of Patent: Nov. 10, 2020

(54) DISCHARGE CONTAINER FOR DISCHARGING CONTENTS ONTO MODELING SURFACE

(71) Applicant: YOSHINO KOGYOSHO CO., LTD., Tokyo (JP)

(72) Inventor: Mai Kase, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/464,921

(22) PCT Filed: Dec. 19, 2017

(86) PCT No.: PCT/JP2017/045481
§ 371 (c)(1),
(2) Date: May 29, 2019

(87) PCT Pub. No.: WO2018/123721
PCT Pub. Date: Jul. 5, 2018

(65) Prior Publication Data

US 2020/0010262 A1 Jan. 9, 2020

(30) Foreign Application Priority Data

Dec. 28, 2016 (JP) ..... 2016-256572

(51) Int. Cl.
*B65D 83/30* (2006.01)

(52) U.S. Cl.
CPC ..... *B65D 83/30* (2013.01)

(58) Field of Classification Search
CPC .... B65D 83/30; B65D 83/303; B65D 83/306; B65D 83/205; B65D 83/753; B65D 83/40;

(Continued)

(56) References Cited

U.S. PATENT DOCUMENTS 6,283,337 B1 * 9/2001 Nakamura ..... B65D 83/285 222/402.1
9,440,056 B2 * 9/2016 Hofland ..... A61P 9/00

FOREIGN PATENT DOCUMENTS

JP S54-131110 A 10/1979
JP H01-123654 A 5/1989

(Continued)

OTHER PUBLICATIONS

Dec. 24, 2019 Office Action issued in Chinese Patent Application No. 201780079450.6.

(Continued)

*Primary Examiner* — Lien M Ngo
(74) *Attorney, Agent, or Firm* — Oliff PLC

(57) ABSTRACT

A discharge container includes a container body that contains contents, a discharger that has a stem, an exterior portion, and a diffusion wall portion. The forming hole includes a central forming hole formed in a central region of the top wall portion and an outer forming hole formed in an outer region. The diffusion chamber internally has a diffusion member located so as to face the diffusion wall portion and located so as to overlap a whole region of at least the central region in the top wall portion in the upward-downward direction, in a plan view when viewed in a container axis direction. The diffusion member is configured to diffuse the contents supplied from the stem outward in the radial direction through a gap between the diffusion member and the diffusion wall portion.

13 Claims, 16 Drawing Sheets

(58) Field of Classification Search
CPC ..... B05B 11/3053; B05B 1/14; B05B 1/02; B05B 1/26
USPC ..... 222/330, 402.13–402.15, 402.11, 402, 222/402.1, 331
See application file for complete search history.

(56) References Cited

FOREIGN PATENT DOCUMENTS

| | | | |
|---|---|---|---|
| JP | H01-103554 | U | 7/1989 |
| JP | 2004-216269 | A | 8/2004 |
| JP | 2015-109997 | A | 6/2015 |
| JP | 2016-026962 | A | 2/2016 |
| JP | 2016-050002 | A | 4/2016 |

OTHER PUBLICATIONS

Jan. 23, 2018 International Search Report issued in International Patent Application No. PCT/JP2017/045481.

* cited by examiner

DISCHARGE CONTAINER FOR DISCHARGING CONTENTS ONTO MODELING SURFACE

TECHNICAL FIELD

The present invention relates to a discharge container.

Priority is claimed on Japanese Patent Application No. 2016-256572, filed on Dec. 28, 2016, the content of which is incorporated herein by reference.

BACKGROUND ART

In the related art, for example, a discharge container as disclosed in Patent Document 1 below is known.

In the discharge container, a saucer which stores contents (liquid) suctioned by an internal piston is provided above the internal piston. The saucer has a communication hole which communicates with the internal piston and a receiving plate located above the communication hole. The receiving plate is connected to an edge of the communication hole via a plurality of fixing legs disposed at an interval in a circumferential direction of the communication hole. Liquid outlet holes through which the contents suctioned by the internal piston are discharged onto an upper surface of the saucer are formed in a gap between the fixing legs adjacent to each other in the circumferential direction.

CITATION LIST

Patent Literature

[Patent Document 1] Japanese Unexamined Utility Model Application, First Publication No. H1-103554

SUMMARY OF INVENTION

Technical Problem

According to the discharge container in the related art, the plurality of liquid outlet holes are arranged at an interval in the circumferential direction by the fixing legs. Accordingly, the contents discharged from the communication hole separately pass through the liquid outlet holes, and thereafter, the contents are discharged onto the upper surface of the saucer. Therefore, a discharge amount of the contents discharged onto the upper surface of the saucer is likely to vary depending on each position along the circumferential direction. Therefore, in a case of forming a modeled object by using the contents discharged onto the upper surface of the saucer, it is difficult to form the modeled object in a desired mode with high accuracy and satisfactory reproducibility.

The present invention is made in view of the above-described circumstances, and an object thereof is to provide a discharge container which can discharge contents while a discharge amount of the contents is prevented from varying at a discharge position, and which can form a modeled object in a desired mode with high accuracy and satisfactory reproducibility on a modeling surface by using the discharged contents.

Solution to Problem

According to a first aspect of the present invention, there is provided a discharge container including a container body that contains contents, a discharger that has a stem erected in a mouth portion of the container body so as to be movable downward in an upward force state, an exterior portion that has a top wall portion located above the stem and having a forming hole penetrating the top wall portion in an upward-downward direction, the exterior portion being configured to discharge the contents passing through the forming hole onto a modeling surface facing upward in the top wall portion, and a diffusion wall portion that is located inside the exterior portion, and that defines a diffusion chamber for supplying the contents from the stem to the forming hole, between the diffusion wall portion and a supply surface facing downward in the top wall portion. The forming hole includes a central forming hole formed in a central region of the top wall portion, and an outer forming hole formed in an outer region located outward in a radial direction from the central region in the top wall portion. A diffusion member is provided in the diffusion chamber, the diffusion member is located so as to face the diffusion wall portion and located so as to overlap at least a whole region of the central region in the top wall portion and the stem in the upward-downward direction, in a plan view when viewed in a container axis direction. The diffusion member is configured to diffuse the contents from the stem outward in the radial direction through a gap between the diffusion member and the diffusion wall portion.

According to the discharge container of the present invention, the stem is caused to move downward against an upward biasing force. In this manner, the contents can be discharged from the stem, and the contents supplied from the stem can be supplied into the diffusion chamber through the gap between the diffusion wall portion and the diffusion member. In this manner, for example, while the contents are diffused in the radial direction inside the diffusion chamber, the contents can be supplied to the central forming hole and the outer forming hole. Therefore, the contents can be discharged onto the modeling surface through the central forming hole and the outer forming hole.

In this way, the contents are once diffused inside the diffusion chamber. Accordingly, it is possible to prevent the contents from being concentrated only in a portion of the forming hole, for example. In a state where the discharge amount of the contents less varies, the contents are likely to be discharged to the modeling surface through the central forming hole and the outer forming hole. Therefore, the contents can be discharged while the discharge amount of the contents discharged onto the modeling surface from varying at the discharge position.

In particular, the diffusion member is located inside the diffusion chamber. Accordingly, a flow of the contents supplied from the stem can be changed by the diffusion member, and the contents can be diffused outward in the radial direction through the gap between the diffusion wall portion and the diffusion member. In this manner, the contents supplied from the stem are caused to flow outward in the radial direction through the above-described gap. Thereafter, while the contents are caused to ascend so as to circulate around the diffusion member, the contents can be caused to flow inward in the radial direction from the outside in the radial direction.

In this way, the flow of the contents supplied from the stem is changed by the diffusion member. Accordingly, it is possible to prevent the contents from linearly flowing from the stem toward the central region of the top wall portion inside the diffusion chamber. The contents can be diffused so that the contents evenly spread throughout the whole area inside the diffusion chamber. Therefore, the contents can be separately discharged in a state of preventing variations in the discharge amount of the contents flowing from the central forming hole and the outer forming hole.

As a result, the contents discharged respectively from the central forming hole and the outer forming hole can be used. In this manner, the modeled object can be finely formed on the modeling surface with high accuracy and satisfactory reproducibility.

In the discharge container according to a second aspect of the present invention, the diffusion member may be located so as to be movable upward by a discharge pressure of the contents supplied from the stem.

In this case, the diffusion member can be displaced upward only when the contents are discharged from the stem. Accordingly, a gap can be formed between the diffusion wall portion and the diffusion member, or a gap can be widened so as to allow the contents to pass therethrough. Therefore, in a case where the stem does not move downward, the gap can be blocked or narrowed.

Therefore, for example, at the time of product distribution or storage, dust can be prevented from entering the stem, and operation reliability and quality can be improved.

In the discharge container according to a third aspect of the present invention, an outer peripheral edge portion side of the diffusion member may be elastically deformable upward by the discharge pressure of the contents supplied from the stem.

In this case, when the contents are discharged from the stem, the outer circumferential edge portion side of the diffusion member is elastically deformed so as to warp upward, for example. Therefore, when the contents are caused to flow outward in the radial direction through the gap between the diffusion wall portion and the diffusion member, a portion of the contents can be caused to positively circulate around the upper side of the diffusion member. In this manner, two flows can be mainly generated inside the diffusion chamber, such as a flow of the contents from the above-described gap toward the central region by way of the outer region of the top wall portion and a flow of the contents from the above-described gap toward the central region after positively circulating around the diffusion member. Therefore, it is possible to effectively prevent the variations in the discharge amount of the contents discharged from the central forming hole and the discharge amount of the contents discharged from the outer forming hole.

In the discharge container according to a fourth aspect of the present invention, a diffusion piece which projects outward in the radial direction may be formed in an outer circumferential edge portion of the diffusion member. The diffusion piece may be located so as to overlap the outer forming hole in the upward-downward direction, in a plan view when viewed in the container axis direction.

In this case, a portion of the contents caused to flow outward in the radial direction through the gap between the diffusion wall portion and the diffusion member is further caused to flow outward in the radial direction along the diffusion piece. Thereafter, while the contents are caused to ascend so as to circulate around the diffusion piece, the contents can be caused to flow toward the outer forming hole. Therefore, the contents can be positively supplied to the outer forming hole, and it becomes easy to more effectively prevent the variations in the discharge amount of the contents.

In the discharge container according to a fifth aspect of the present invention, a plurality of the outer forming holes may be formed at an interval in a circumferential direction on an entire periphery of the top wall portion. A plurality of the diffusion pieces may be formed at an interval in the circumferential direction on an entire periphery of the diffusion member.

In this case, even in a case where the plurality of outer forming holes are formed in the outer region of the top wall portion, the contents can be positively supplied to each of the outer forming holes. Accordingly, without being affected by the number of the outer forming holes, it is easy to effectively prevent the variations in the discharge amount of the contents.

The diffusion pieces may be located so as to separately overlap the outer forming holes in the upward-downward direction, or may overlap only some of the outer forming holes.

In the discharge container according to a sixth aspect of the present invention, a plurality of slits extending inward in the radial direction from a portion located between the diffusion pieces adjacent to each other in the circumferential direction may be formed in the outer circumferential edge portion of the diffusion member, the slits being formed at an interval in the circumferential direction. A portion located between the slits adjacent to each other in the circumferential direction, in the outer circumferential edge portion of the diffusion member may be elastically deformable upward by the discharge pressure of the contents supplied from the stem.

In this case, when the contents are discharged from the stem, a portion located between the slits adjacent to each other in the circumferential direction in the outer circumferential edge portion of the diffusion member is elastically deformed so as to warp upward, for example. Therefore, out of the contents caused to flow outward in the radial direction through the gap between the diffusion wall portion and the diffusion member, a portion of the contents other than the contents flowing along the diffusion piece can be caused to positively circulate around the upper side of the diffusion member.

Therefore, even if the plurality of diffusion pieces are provided, the contents can be positively supplied to the central forming hole. Therefore, it is possible to adjust the discharge amount of the contents to be discharged from the central forming hole and the discharge amount of the contents to be separately discharged from the plurality of outer forming holes. Accordingly, it is possible to effectively prevent the variations in the discharge amount.

The slit may be formed so as to extend inward in the radial direction from both end portions in the circumferential direction in the diffusion piece. In this case, a projecting length of the diffusion piece can be apparently lengthened by the slit. Therefore, the diffusion piece can be more effectively used.

In the discharge container according to a seventh aspect of the present invention, a plurality of the central forming holes may be formed at an interval in each of two directions orthogonal to each other in a plane of the top wall portion.

In this case, the plurality of central forming holes can be arranged in a lattice pattern (matrix arrangement) in two directions in the plane of the top wall portion. Accordingly, the contents discharged through the central forming hole are used. In this manner, a modeled object in which modeled pieces are regularly arranged in the two directions can be formed on the modeling surface. In particular, the discharge amount of the contents is prevented from varying in each of the central forming holes. Accordingly, the respective modeled pieces can be brought into the same state. Therefore, it is possible to form an excellently designed modeled object in which the respective modeled pieces are beautifully and regularly arranged.

Advantageous Effects of Invention

According to the discharge container of the present invention, contents can be discharged while a discharge amount of the contents is prevented from varying at a discharge position. A modeled object can be formed in a desired mode with satisfactory reproducibility and high accuracy on a modeling surface by the discharged contents.

DESCRIPTION OF EMBODIMENTS

Hereinafter, an embodiment of a discharge container according to the present invention will be described with reference to the drawings.

Figure 1:
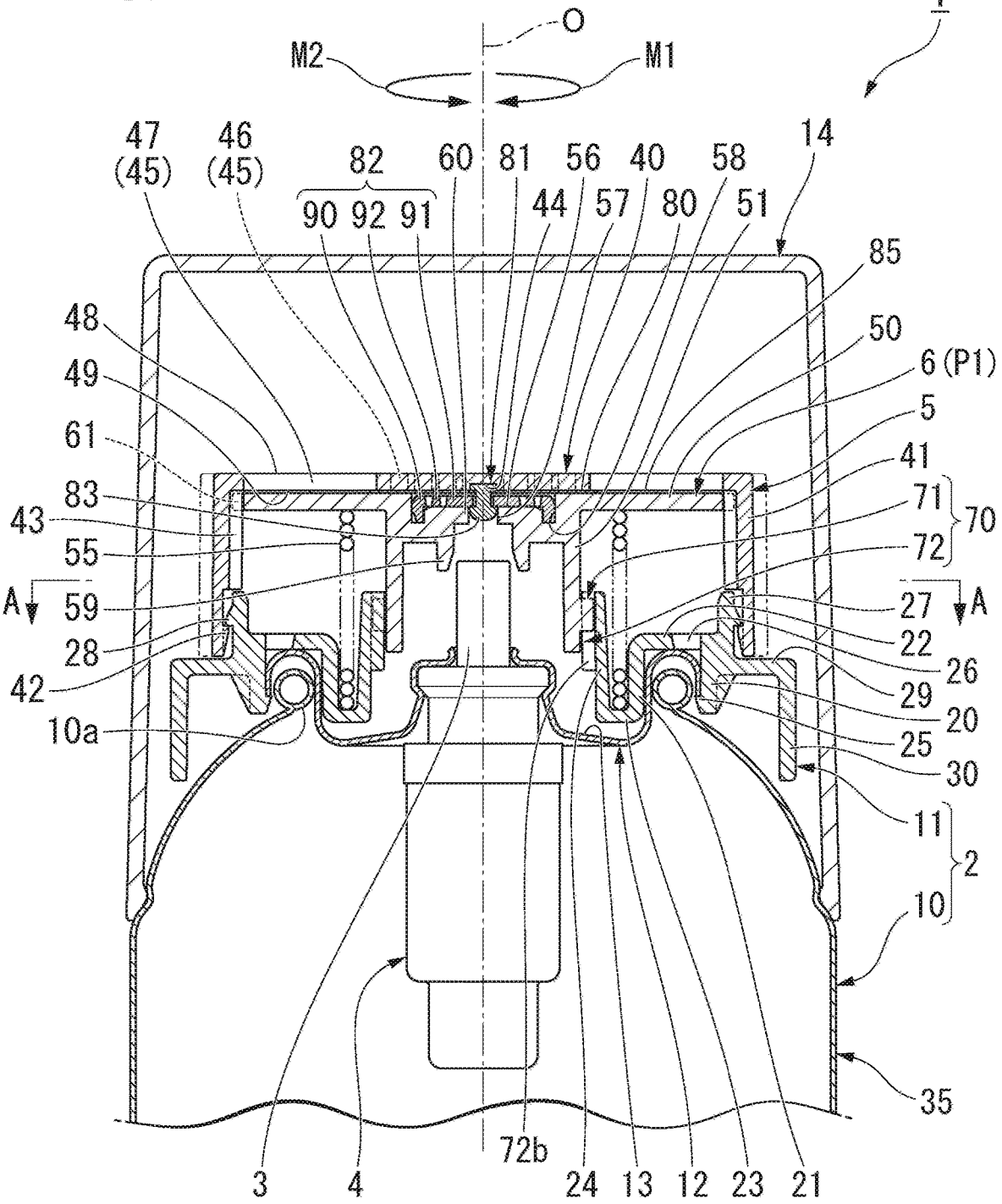
FIG. 1 is a longitudinal sectional view showing an embodiment of a discharge container according to the present invention.

As shown in FIG. 1, a discharge container 1 according to the present embodiment includes a container body 2 having a bottomed cylindrical container main body 10 for containing contents, a discharger 4 having a stem 3, a capped cylindrical exterior portion 5 mounted on the container body 2, and an inner plate 6 located inside the exterior portion 5.

The container main body 10 and the exterior portion 5 are arranged in a state where respective center axes thereof are located on a common axis. According to the present embodiment, the common axis will be referred to as a container axis O, a mouth portion 10*a* side of the container main body 10 in a direction along the container axis O will be referred to upward, and a bottom portion side (not shown) of the container main body 10 will be referred to as downward. Therefore, the direction along the container axis O direction will be referred to as an upward-downward direction. In addition, a direction orthogonal to the container axis O in a plan view when viewed in the direction of the container axis O will be referred to as a radial direction, and a direction turning around the container axis O will be referred to as a circumferential direction.

As the contents, for example, it is possible to suitably adopt a foam material or a highly viscous material capable of maintaining a shape for at least a prescribed time after the contents are discharged. In the present embodiment, a case of using foamed or highly viscous contents will be described as an example.

The container body 2 includes a container main body 10 and a fixing member 11 mounted on a mouth portion 10*a* of the container main body 10. The mouth portion 10*a* of the container main body 10 functions as a mouth portion of the container body 2.

The container main body 10 is internally hermetically sealed with the top wall plate 12 covering the mouth portion 10*a*. The top wall plate 12 has an annular recess portion 13 extending in the circumferential direction and recessed downward. The fixing member 11 is formed in a multiple cylinder shape coaxial with the container axis O, and is fixed to the mouth portion 10*a* of the container main body 10.

A capped cylindrical top cover 14 for covering the exterior portion 5 is detachably mounted on the container main body 10.

Figure 2:
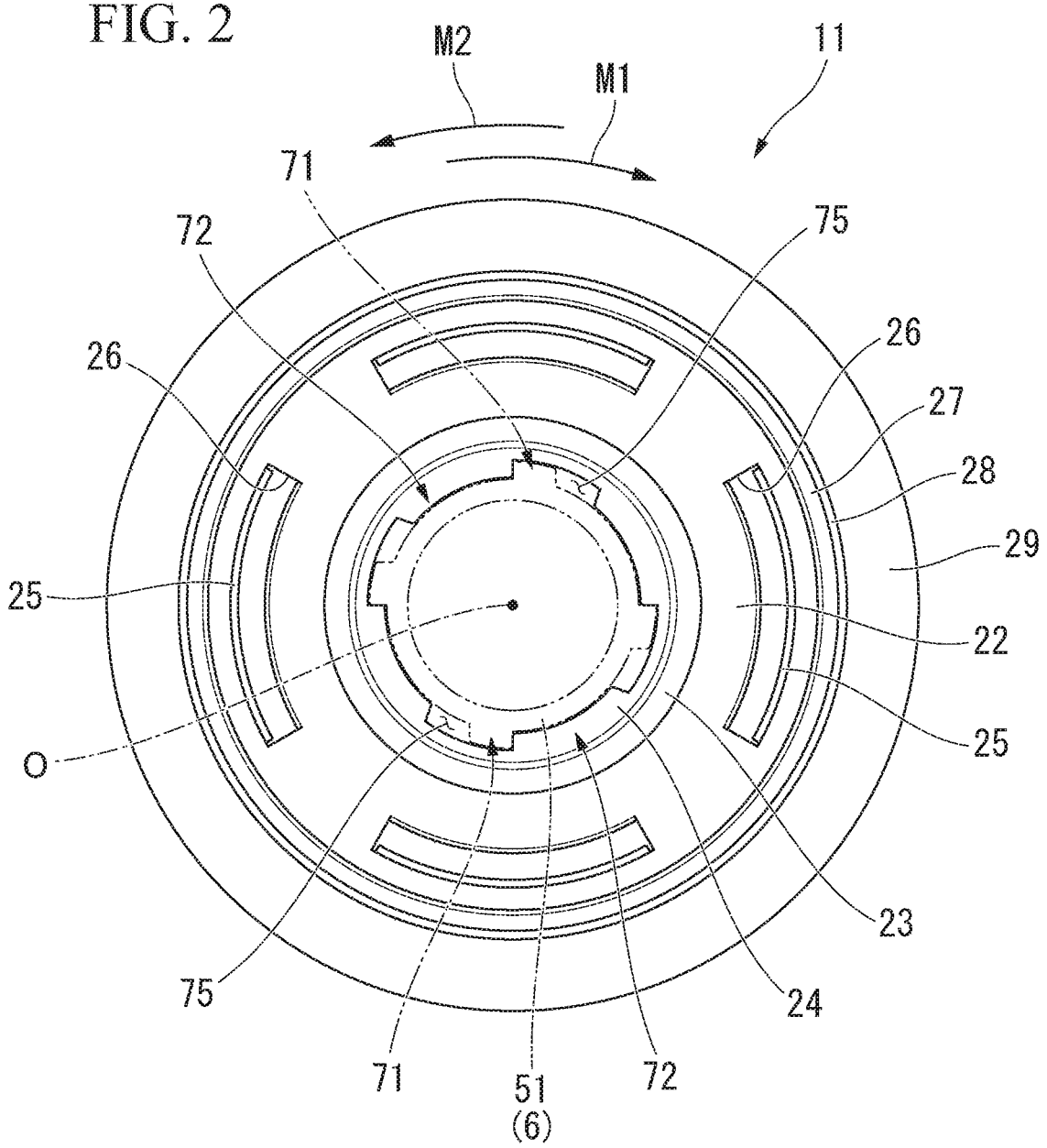
FIG. 2 is a plan view of a fixing member when viewed from line A-A shown in FIG. 1.

As shown in FIGS. 1 and 2, the fixing member 11 is fixed to the mouth portion 10*a* of the container main body 10 so that the fixing member 11 is not rotatable around the container axis O and is not ascendable.

The fixing member 11 includes a cylindrical outer cylindrical portion 20 surrounding the mouth portion 10*a* of the container main body 10 from the outside in the radial direction, a cylindrical inner cylinder portion 21 located inside the annular recess portion 13, an annular connecting portion 22 integrally connecting an upper end portion of the outer cylinder portion 20 and an upper end portion of the inner cylinder portion 21 to each other in the radial direction, an annular receiving portion 23 extending inward in the radial direction from a lower end portion of the inner cylinder portion 21, and a cylindrical inner support cylinder portion 24 extending upward from an inner circumferential edge portion of the receiving portion 23. The inner cylinder portion 21, the connecting portion 22, and the inner support cylinder portion 24 are arranged inside the annular recess portion 13.

The lower end portion of the outer cylinder portion 20 has a first engaging projection 25 which projects inward in the radial direction. A plurality of the first engaging projections 25 are formed at an interval in the circumferential direction. As shown in FIG. 2, the first engaging projection 25 is formed in an arc shape in a plan view when viewed in the direction of the container axis O. Four first engaging projections 25 are formed at an equal interval in the circumferential direction. However, the shape and the number of the first engaging projections 25 are not limited to this case.

The fixing member 11 is integrally fixed to the mouth portion 10*a* of the container main body 10 in a state where a rotational movement around the container axis O and an upward movement are regulated by undercut engagement of the first engaging projection 25 with respect to an outer circumferential edge portion of the top wall plate 12 and caulking of the outer cylinder portion 20 with respect to the mouth portion 10*a*.

The connecting portion 22 is located above the mouth portion 10*a* of the container main body 10, and integrally connects the upper end portion of the outer cylinder portion 20 and the upper end portion of the inner cylinder portion 21 to each other in the radial direction. The connecting portion 22 has a releasing hole 26 formed so as to penetrate the connecting portion 22 in the upward-downward direction when the first engaging projection 25 is formed. Therefore, the releasing hole 26 is formed in an arc shape in a plan view when viewed in the direction of the container axis O, and four releasing holes 26 are formed at an equal interval in the circumferential direction so as to be located above the first engaging projection 25.

A cylindrical outer support cylinder portion 27 is formed in the outer circumferential edge portion of the connecting portion 22. The cylindrical outer support cylinder portion 27 extends upward from the outer circumferential edge portion of the connecting portion 22. The outer support cylinder portion 27 is located outward in the radial direction from the outer cylinder portion 20. The outer circumferential surface of the outer support cylinder portion 27 has a second engaging projection 28 which projects outward in the radial direction.

As shown in FIG. 2, the second engaging projection 28 is annularly formed over an entire periphery of the outer support cylinder portion 27. However, a shape of the second engaging projection 28 is not limited thereto, and a plurality of the second engaging projections 28 may be formed at an interval in the circumferential direction.

The inner cylinder portion 21 is fitted to the outer circumferential surface of the annular recess portion 13 from the inside in the radial direction. The inner support cylinder portion 24 projects upward of the connecting portion 22. As shown in FIG. 1, a position of the upper end portion of the inner support cylinder portion 24 in the upward-downward direction is substantially the same as a position of the upper end portion of the outer support cylinder portion 27.

Furthermore, the fixing member 11 includes an annular flange portion 29 extending outward in the radial direction from a central portion in the upward-downward direction in the outer cylinder portion 20, and an outer shell cylinder portion 30 extending downward an outer circumferential edge portion of the flange portion 29. The outer support cylinder portion 27 and the flange portion 29 are formed integrally with each other.

As shown in FIG. 1, the discharger 4 includes the stem 3 erected in the mouth portion 10*a* of the container main body 10 so as to be movable downward in an upward force state, and is supported by the top wall plate 12. In this manner, the discharger 4 is located coaxially with the container axis O, and is located inside the mouth portion 10*a* of the container main body 10. The stem 3 is located coaxially with the container axis O, and projects upward of the top wall plate 12.

The discharger 4 internally has a discharge valve (not shown) disposed in a portion located inside the container main body 10. The discharge valve is opened when the stem 3 is pressed down against the container body 2. In this manner, the contents inside the container main body 10 can be discharged from the upper end portion of the stem 3 through the inside of the stem 3. If the stem 3 which is pressed down is released, the stem 3 ascends by using an upward biasing force acting on the stem 3, and the discharge valve is closed so as to stop discharging the contents.

The container main body 10 and the discharger 4 configure a discharge container main body which discharges the contents contained inside the container main body 10 from the stem 3. As shown in FIG. 1, as the discharge container main body 35, an aerosol can internally contain the contents in a liquid state is adopted.

Figure 3:
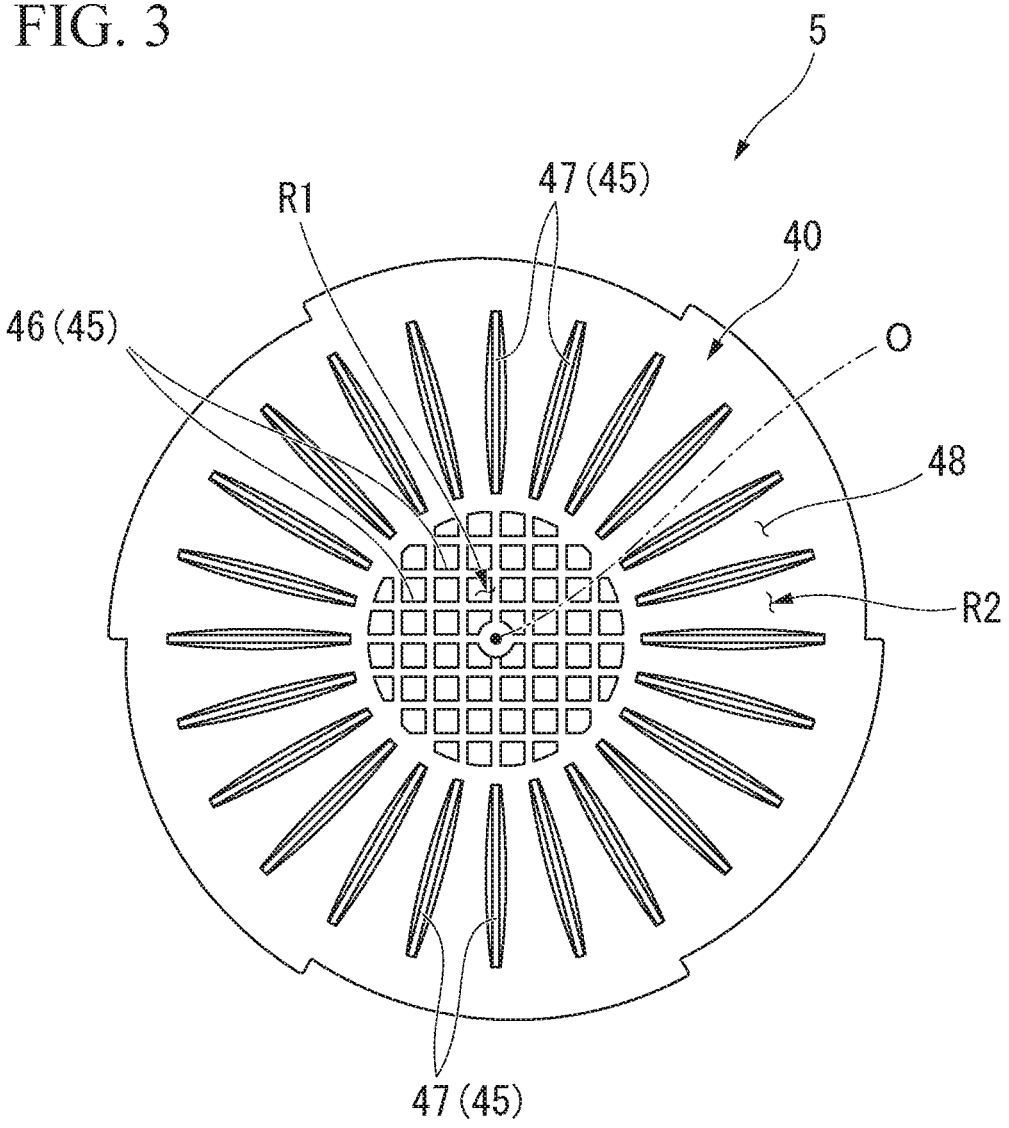
FIG. 3 is a top view of an exterior portion shown in FIG. 1.

As shown in FIGS. 1 and 3, the exterior portion 5 is formed in a capped cylindrical shape having a top wall portion 40 located above the stem 3 and having a circular shape in a plan view, and a circumferential wall portion 41 extending downward from the outer circumferential edge portion of the top wall portion 40. The exterior portion 5 is located coaxially with the container axis O.

The circumferential wall portion 41 is formed in a cylindrical shape surrounding the outer support cylinder portion 27 of the fixing member 11 from the outside in the radial direction. The lower end portion of the circumferential wall portion 41 has a third engaging projection 42 which projects inward in the radial direction and which is undercut-fitted to the second engaging projection 28 formed in the outer support cylinder portion 27.

The third engaging projection 42 is fitted to the second engaging projection 28 so as to be rotatable around the container axis O. In this manner, the circumferential wall portion 41 is rotatably supported by the outer support cylinder portion 27. Therefore, the whole exterior portion 5 is mounted so as to be rotatable around the container axis O in a state where the exterior portion 5 is prevented from slipping upward with respect to the fixing member 11.

According to the present embodiment, a plurality of the third engaging projections 42 are formed at an interval in the circumferential direction. However, a shape of the third engaging projection 42 is not limited thereto. For example, the third engaging projection 42 may be annularly formed over the entire periphery of the circumferential wall portion 41.

A projecting rib 43 projecting inward in the radial direction is formed on an inner circumferential surface of a portion located above the outer support cylinder portion 27 in the circumferential wall portion 41. A plurality of the projecting ribs 43 are formed longitudinally along the upward-downward direction, and are formed at an interval in the circumferential direction.

The lower end edge of the projecting rib 43 is in contact with or close to the upper end portion of the outer support cylinder portion 27. In this manner, the downward movement of the exterior portion 5 with respect to the fixing member 11 is regulated. As described previously, the exterior portion 5 is prevented from slipping upward with respect to the fixing member 11. Accordingly, while the downward movement with respect to the fixing member 11 is regulated, the exterior portion 5 is mounted in a state where the movement in the upward-downward direction with respect to the fixing member 11 is regulated.

The lower end portion of the circumferential wall portion 41 is in contact with or close to the flange portion 29 of the fixing member 11 from above.

The top wall portion 40 has a forming hole 45 penetrating the top wall portion 40 in the upward-downward direction. According to the present embodiment, a surface facing upward in the top wall portion 40 is defined as a modeling surface 48 for discharging the contents from the forming hole 45, and a surface facing downward in the top wall portion 40 is defined as a supply surface 49 on which the contents supplied from the stem 3 reach.

The forming hole 45 is formed so as to be open to the modeling surface 48 and the supply surface 49. On the supply surface 49 side of the top wall portion 40, a containing recess portion 44 recessed in a circular shape in a plan view is formed coaxially with the container axis O.

The forming hole 45 includes a central forming hole 46 formed in a central region R1 of the top wall portion 40, and an outer forming hole 47 formed in an outer region R2 located outward in the radial direction from the central region R1 in the top wall portion 40.

The central region R1 is a region substantially located in the central portion of the top wall portion 40 in a plan view when viewed in the direction of the container axis O. Therefore, the central region R1 is not limited by a ratio between an area occupied by the central region R1 and an area occupied by the outer region R2 within a surface area of the top wall portion 40. For example, the central region R1 is a region which is located in the central portion of the top wall portion 40 and which is surrounded by the diameter of approximately ⅓ to ½ of the diameter of the top wall portion 40.

As shown in FIG. 3, the central region R1 is a circular region formed using the diameter of approximately ⅓ of the diameter of the top wall portion 40 in a plan view when viewed in the direction of the container axis O, and the whole discharger 4 including the stem 3 is accommodated below the central region R1.

The outer region R2 is formed in an annular shape surrounding the central region R1.

The central forming hole 46 is formed in a square shape in a plan view when viewed in the direction of the container axis O, and a plurality of the central forming holes 46 are formed in a densely aggregated state inside the central region R1. Specifically, the plurality of central forming holes 46 are arranged in a lattice pattern (matrix arrangement) at the same pitch in each of two directions orthogonal to each other in a plane of the top wall portion 40.

However, the shape or the number of the central forming holes 46 is not limited thereto, and may be freely designed.

The outer forming hole 47 is formed in a slit shape extending along the radial direction, and a plurality of the outer forming holes 47 are formed at an equal interval in the circumferential direction over the entire periphery of the outer region R2. Therefore, the plurality of outer forming holes 47 are arranged radially around the container axis O.

A slit width of the outer forming hole 47 is smaller than a length of one side of the central forming hole 46 formed in a square shape (for example, equal to or smaller than a half of one side). A slit length is formed to be slightly smaller than the diameter of region R1 in the top wall portion 40.

If the contents are caused to separately pass through the forming hole 45 configured as described above, a plurality of modeled pieces are formed on the modeling surface 48, and the plurality of modeled pieces are combined with each other, thereby forming a modeled object on the modeling surface 48. As the modeled object, for example, shapes such as various flowers, characters, and logotypes can be modeled.

According to the present embodiment, the central forming holes 46 having a square shape are aggregated and arranged in a lattice pattern in the central region R1, and the outer forming holes 47 having a slit shape are radially arranged in the outer region R2. Accordingly, the modeled pieces obtained by the central forming hole 46 and the outer forming hole 47 are combined with each other. In this manner, it is possible to form the modeled object having a sunflower shape.

A shape or the number of the central forming holes 46 and the outer forming holes 47 is not limited to the above-described case. For example, the shape or the number may be appropriately changed in accordance with a shape of the modeled object or usage of the contents.

Furthermore, in each of the central forming holes 46 and the outer forming holes 47, for example, appropriate designing, changing, or adjusting can be performed on the number, the width, the length, the shape, an angle of the inner wall face of the forming hole in a case of a longitudinal sectional view (for example, whether to form a vertical surface or a tapered surface Etc.), and an interval between the adjacent forming holes. In this manner, it is possible to form a wide variety of the modeled objects.

As shown in FIG. 1, the inner plate 6 includes an inner plate main body 50 fitted into the circumferential wall portion 41 of the exterior portion 5 so as to be slidable upward and downward, and a guide cylinder portion 51 projecting downward from the inner plate main body 50, and is located inside the exterior portion 5 so as to be movable downward in an upward force state.

Figure 4:
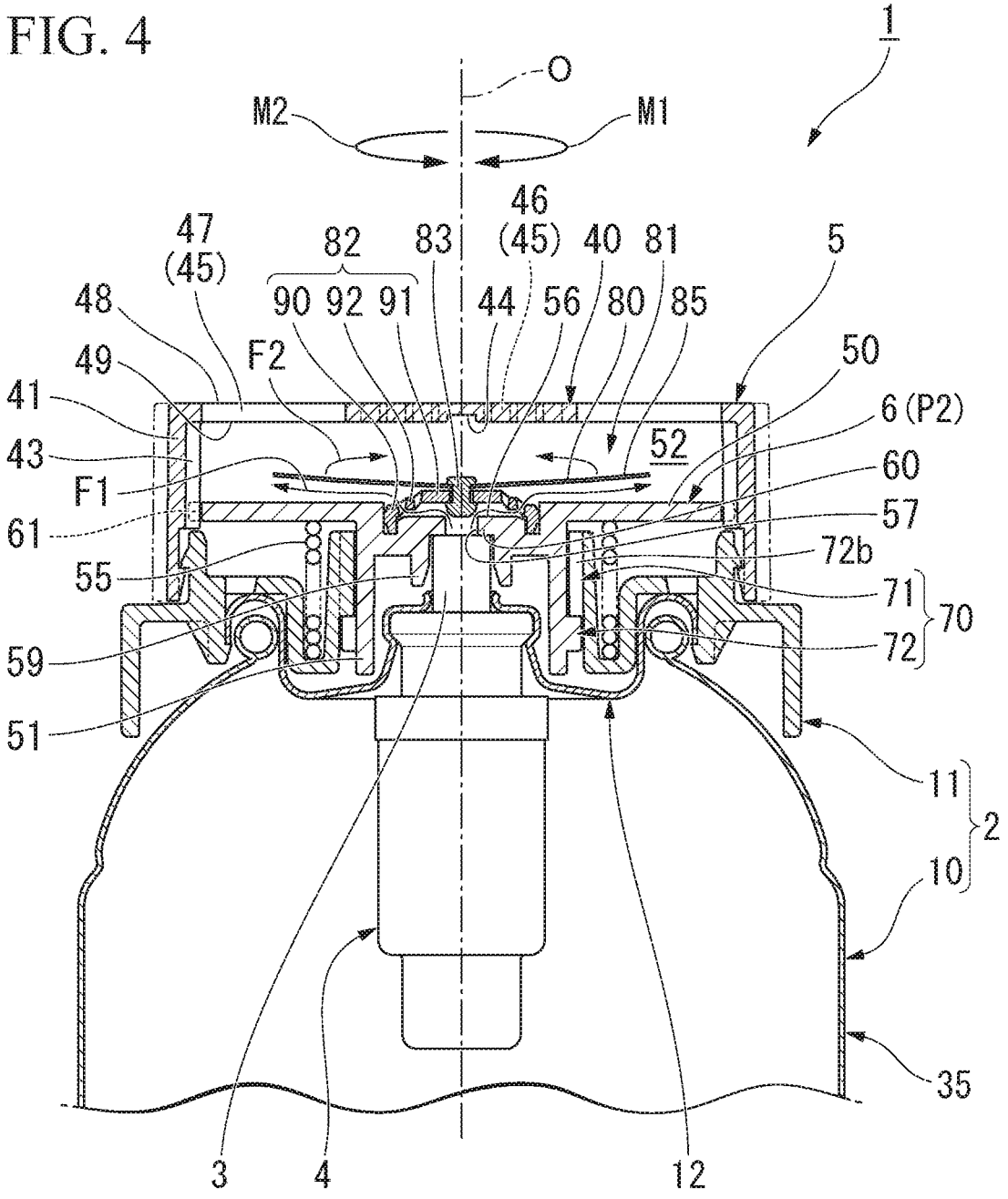
FIG. 4 is a longitudinal sectional view showing a state where an inner plate is caused to descend from an ascending end position to a descending end position by rotating the exterior portion from a state shown in FIG. 1.

As shown in FIG. 1, the inner plate 6 moves upward and downward between an ascending end position (standby position) P1 where the inner plate main body 50 is in contact with or close to the supply surface 49 of the top wall portion 40 and a descending end position (discharge position) P2 where the stem 3 is caused to descend as shown in FIG. 4 so as to supply the contents from the stem 3 into the diffusion chamber 52.

As the inner plate 6 descends, the inner plate main body 50 is separated downward from the supply surface 49, thereby forming the diffusion chamber 52 which supplies the contents to the forming hole 45 while diffusing the contents supplied from the stem 3 between the exterior portion 5 and the inner plate main body 50.

However, at the ascending end position P1, the inner plate 6 does not need to be in contact with or close to the supply surface 49, and may be separated downward from the supply surface 49.

As shown in FIG. 1, the inner plate main body 50 is formed in a disk shape extending in a plane orthogonal to the container axis O, and the outer circumferential edge portion is slidable in the upward-downward direction on the inner circumferential surface of the circumferential wall portion 41. The inner plate main body 50 faces the supply surface 49 from below. As described above, the inner plate main body 50 functions as a diffusion wall portion which defines the diffusion chamber 52 between the supply surface 49 and the inner plate main body 50.

A coil spring 55 in a compressed state is attached between the inner plate main body 50 and the receiving portion 23. The coil spring 55 is located between the inner cylinder portion 21 of the fixing member 11 and the inner support cylinder portion 24. In this manner, the coil spring 55 is attached in a state of being positioned in the radial direction. Therefore, the whole inner plate 6 is stably biased upward by the coil spring 55.

A recess portion 56 recessed one step downward is formed in the central portion located inward in the radial direction from the guide cylinder portion 51 in the inner plate main body 50. The center of the recess portion 56 has a communication hole 57 having a circular shape in a plan view which penetrates the inner plate main body 50 in the upward-downward direction. The communication hole 57 is located coaxially with the container axis O, and is formed to have the same diameter as the inner diameter of the stem 3.

A bottom surface of the recess portion 56 has an annular recess portion 58 recessed further downward. A lower surface of the recess portion 56 has a cylindrical connecting cylinder portion 59 projecting downward.

The connecting cylinder portion 59 is located coaxially with the container axis O, and is formed so that the inner diameter of the connecting cylinder portion 59 is slightly larger than the outer diameter of the stem 3. In this manner, when the inner plate 6 descends, the stem 3 can enter the connecting cylinder portion 59 from below.

In the upward-downward direction, a position of the lower end portion of the connecting cylinder portion 59 is substantially the same as a position of the upper end portion of the stem 3.

Whereas the inner diameter of the connecting cylinder portion 59 is formed to be slightly larger than the outer diameter of the stem 3, the inner diameter of the communication hole 57 is the same diameter as the inner diameter of the stem 3. Accordingly, an opening circumferential edge portion of the communication hole 57 is located above an opening end of the stem 3, and functions as a locking portion 60 locked to the opening end of the stem 3 when the inner plate 6 descends.

Figure 5:
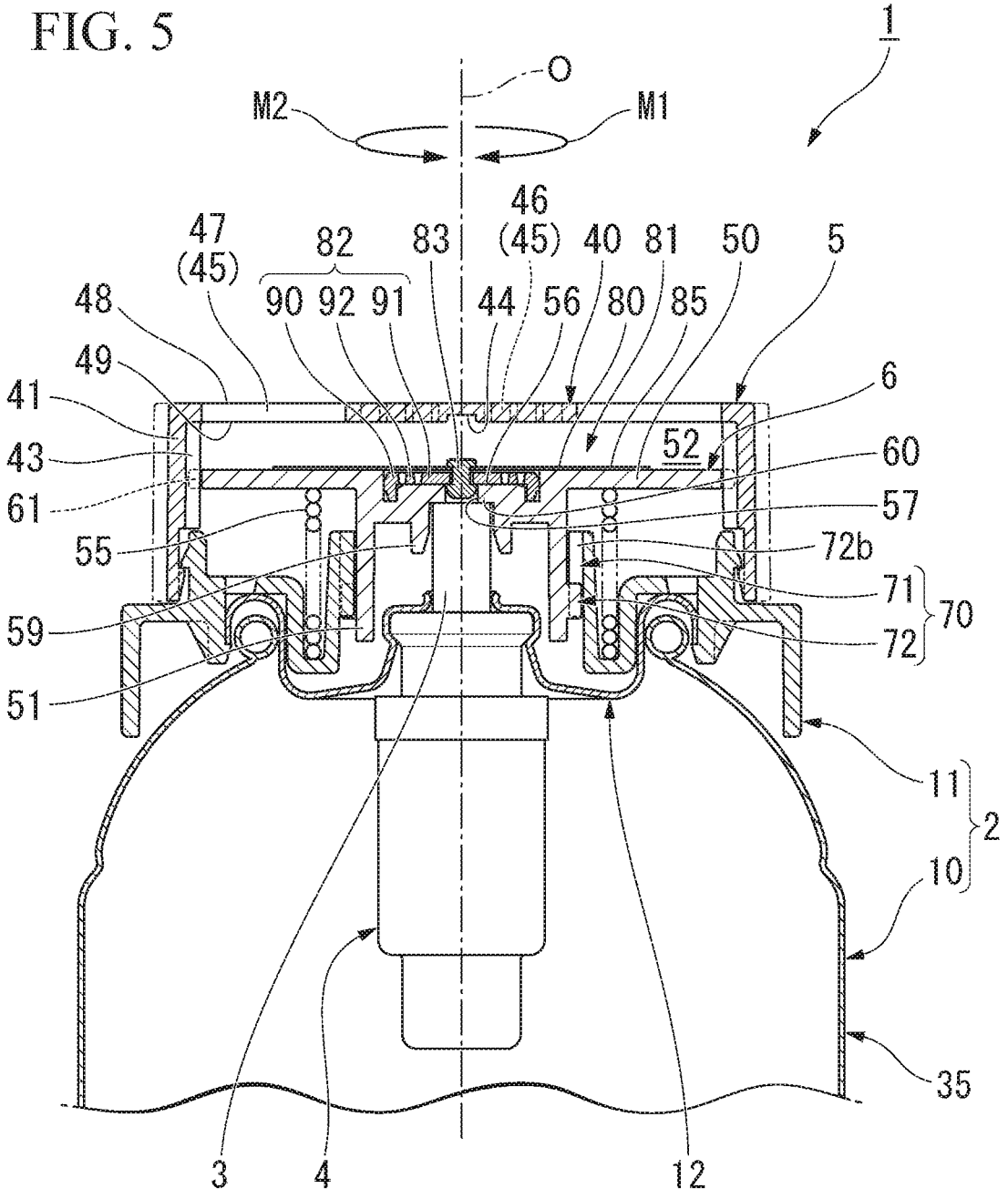
FIG. 5 is a longitudinal sectional view showing a state where the inner plate is caused to descend from the ascending end position to a position locked to a stem by rotating the exterior portion from the state shown in FIG. 1.

In this manner, the inner plate 6 can descend without pressing down the stem 3 until the locking portion 60 is locked to the opening end of the stem 3 as shown in FIG. 5. After the locking portion 60 is locked to the stem 3, the inner plate 6 can press down the stem 3 as shown in FIG. 4.

As shown in FIG. 1, in the outer circumferential edge portion of the inner plate main body 50, a plurality of recess portions 61 recessed inward in the radial direction and penetrating the inner plate main body 50 in the upward-downward direction are formed corresponding to the projecting ribs 43 at an interval in the circumferential direction. Then, the projecting rib 43 enters the recess portion 61, and both of these engage with each other in the circumferential direction. Since the recess portion 61 and the projecting rib 43 engage with each other in the circumferential direction, the exterior portion 5 and the inner plate 6 are combined with each other so that both of these are not relatively rotatable. In this manner, the inner plate 6 is integrally rotated around the container axis O in accordance with the rotation of the exterior portion 5.

However, the projecting rib 43 and the recess portion 61 engage with each other in the circumferential direction, but do not engage with each other in the direction of the container axis O. Therefore, the inner plate 6 is configured to be movable relative to the exterior portion 5 in the upward-downward direction.

The projecting rib 43 is formed on the exterior portion 5 side, and the recess portion 61 is locked to the inner plate 6 side. However, the configuration is not limited to this case. The recess portion 61 may be formed on the exterior portion 5 side, a projection part which engages with the recess portion 61 on the inner plate 6 side in the circumferential direction may be formed, and both of these may engage with each other in the circumferential direction. Furthermore, as an alternative method (engaging means), the inner plate 6 and the exterior portion 5 may engage with each other so that both of these are not rotatable in the circumferential direction.

The guide cylinder portion 51 is located inside the inner support cylinder portion 24, and is supported by the inner support cylinder portion 24 so as to be rotatable around the container axis O.

The lower end portion of the guide cylinder portion 51 is located in the central portion of the inner support cylinder portion 24 in the upward-downward direction.

A conversion mechanism 70 for converting a rotational operation around the container axis O of the exterior portion 5 and the inner plate 6 with respect to the container body 2 to an operation of the inner plate 6 in the upward-downward direction is disposed between the guide cylinder portion 51 and the inner support cylinder portion 24. In the circumferential direction, a direction turning clockwise around the container axis O in a top view of the discharge container 1 will be referred to as a first rotation direction M1, and a side opposite thereto will be referred to as a second rotation direction M2.

The conversion mechanism 70 is configured to include a sliding projection portion 71 and a guide projection portion 72. In a case where the sliding projection portion 71 is disposed in the guide cylinder portion 51, the guide projection portion 72 is disposed in the inner support cylinder portion 24. In a case where the sliding projection portion 71 is disposed in the inner support cylinder portion 24, the guide projection portion 72 is disposed in the guide cylinder portion 51.

Specifically, as shown in FIGS. 1 and 2, the sliding projection portion 71 is formed so as to project outward in the radial direction from the outer circumferential surface of the guide cylinder portion 51. The guide projection portion 72 is formed so as to project inward in the radial direction from the inner circumferential surface of the inner support cylinder portion 24. The guide projection portion 72 is formed throughout the central portion in the upward-downward direction from the upper end portion of the inner support cylinder portion 24. The upper end portion of the sliding projection portion 71 is located below the upper end portion of the guide projection portion 72.

Figure 6:
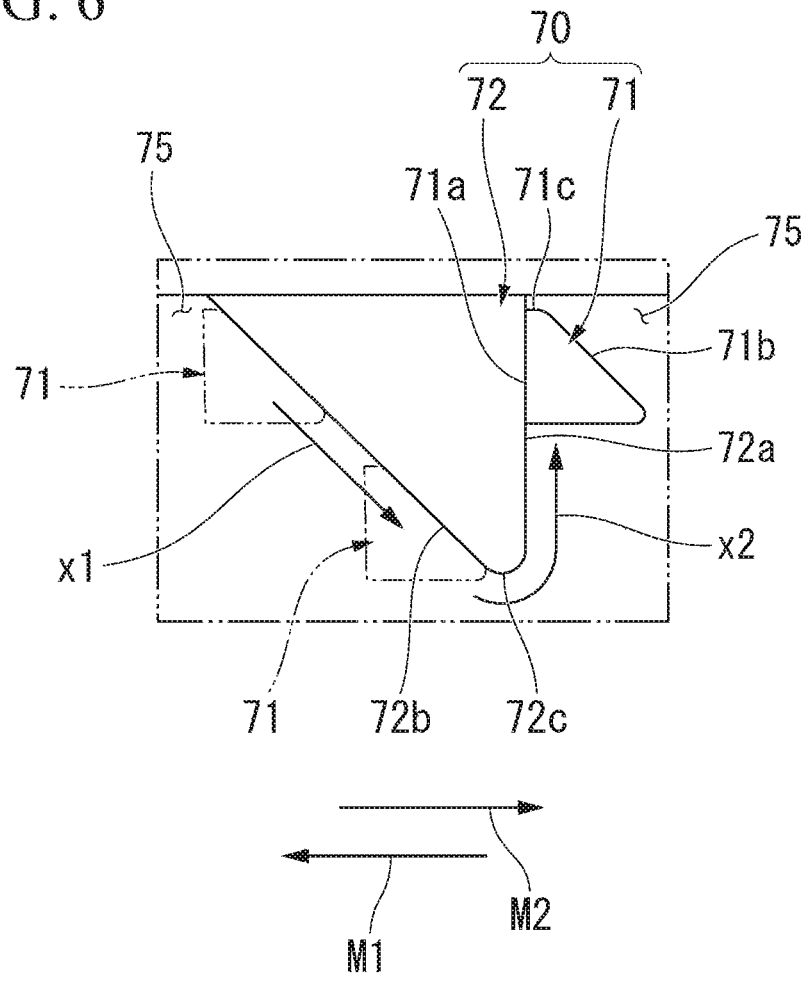
FIG. 6 is a development view in which a conversion mechanism shown in FIG. 1 is developed in a circumferential direction.

As shown in FIGS. 1, 2, and 6, the guide projection portion 72 includes a first vertical surface 72*a* extending in the upward-downward direction and a first inclined surface 72*b* gradually separated from the first vertical surface 72*a* to a side in the first rotation direction M1 as the first inclined surface 72*b* faces upward from the lower end portion of the first vertical surface 72*a*, and is formed in a substantially triangular shape projecting downward. The lower end portion of the first vertical surface 72*a* and the lower end portion of the first inclined surface 72*b* are connected to each other via a curved surface portion 72*c* projecting downward.

The sliding projection portion 71 includes a second vertical surface 71*a* extending in the upward-downward direction and a second inclined surface 71*b* gradually separated from the second vertical surface 71*a* to a side in the second rotation direction M2 as the second inclined surface 71*b* faces downward from the upper end portion of the second vertical surface 71*a*, and is formed in a substantially triangular shape projecting upward. The upper end portion of the second vertical surface 71*a* and the upper end portion of the second inclined surface 71*b* are connected to each other via a curved surface portion 71*c* projecting upward.

The sliding projection portion 71 is smaller than the guide projection portion 72 as a whole, and is formed in a shape approximately similar to the guide projection portion 72. Therefore, an angle formed between the first vertical surface 72*a* and the first inclined surface 72*b* and an angle formed between the second vertical surface 71*a* and the second inclined surface 71*b* are equal to each other.

The guide projection portion 72 and the sliding projection portion 71 are configured as described above. Accordingly, depending on a relationship between the first inclined surface 72*b* of the guide projection portion 72 and the second inclined surface 71*b* of the sliding projection portion 71, the rotation of the inner plate 6 is allowed in the second rotation direction M2 with respect to the container body 2. Furthermore, depending on a relationship among the first vertical surface 72*a* of the guide projection portion 72, the second vertical surface 71*a* of the sliding projection portion 71, and an upward biasing force applied to the inner plate 6 by the coil spring 55, the rotation of the inner plate 6 is regulated in the first rotation direction M1 with respect to the container body 2.

In this way, the sliding projection portion 71, the guide projection portion 72, and the coil spring 55 configure a ratchet mechanism which allows the rotation of the inner plate 6 around the container axis O in only one direction (second rotation direction M2) with respect to the container body 2.

The ratchet mechanism may be configured to allow the rotation of the inner plate 6 in the first rotation direction M1 with respect to the container body 2, and to regulate the rotation in the second rotation direction M2.

Furthermore, instead of adopting the ratchet mechanism which regulates the rotation around the container axis O in any one direction, the inner plate 6 may be configured to be rotatable with respect to the container body 2 in both directions of the first rotation direction M1 and the second rotation direction M2. In this case, in FIG. 6, for example, instead of the second vertical surface 71*a*, the sliding projection portion 71 is formed which has the inclined surface gradually extending to the side in the first rotation direction M1 as the inclined surface faces downward from the curved surface portion 71*c*. Correspondingly, instead of the first vertical surface 72*a*, the guide projection portion 72 may be formed which has the inclined surface gradually extending to the side in the second rotation direction M2 as the inclined surface faces upward from the curved surface portion 72*c*.

As shown in FIG. 2, a plurality of the guide projection portions 72 are formed on the inner circumferential surface of the inner support cylinder portion 24 at an equal interval in the circumferential direction. In this manner, the inner circumferential surface of the inner support cylinder portion 24 has a clearance portion 75 secured in a portion located between the guide projection portions 72 adjacent to each other in the circumferential direction. Accordingly, the clearance portion 75 and the guide projection portion 72 are alternately arranged in the circumferential direction.

The width along the circumferential direction in the clearance portion 75 is slightly larger than the width along the circumferential direction in the sliding projection portion 71. In this manner, in a case where the sliding projection portion 71 is located in the clearance portion 75, a slight clearance is generated in the circumferential direction between the sliding projection portion 71 and the guide projection portion 72. Therefore, for example, even in a case where an excessively strong rotational force is applied to the inner plate 6, the sliding projection portion 71 is inhibited from continuously riding on the plurality of guide projection portions 72 in the circumferential direction, and the contents can be prevented from being continuously discharged.

A plurality of the sliding projection portions 71 are formed on the outer circumferential surface of the guide cylinder portion 51 at an equal interval in the circumferential direction. As shown in FIG. 2, the sliding projection portions 71 are disposed as many as the guide projection portions 72 so as to correspond to the guide projection portions 72. However, the number of the sliding projection portions 71 may not be the same as the number of the guide projection portions 72. For example, the number of the sliding projection portions 71 may be smaller than the number of the guide projection portions 72.

As shown in FIG. 1, the diffusion chamber 52 (refer to FIGS. 4 and 5) defined between the inner plate main body 50 and the top wall portion 40 internally has a diffusion unit 81 having a diffusion sheet (diffusion member) 80 which is located to face the inner plate main body 50 and which is located so as to overlap at least the central region R1 in the top wall portion 40 in the upward-downward direction in a plan view when viewed in the direction of the container axis O.

Figure 7:
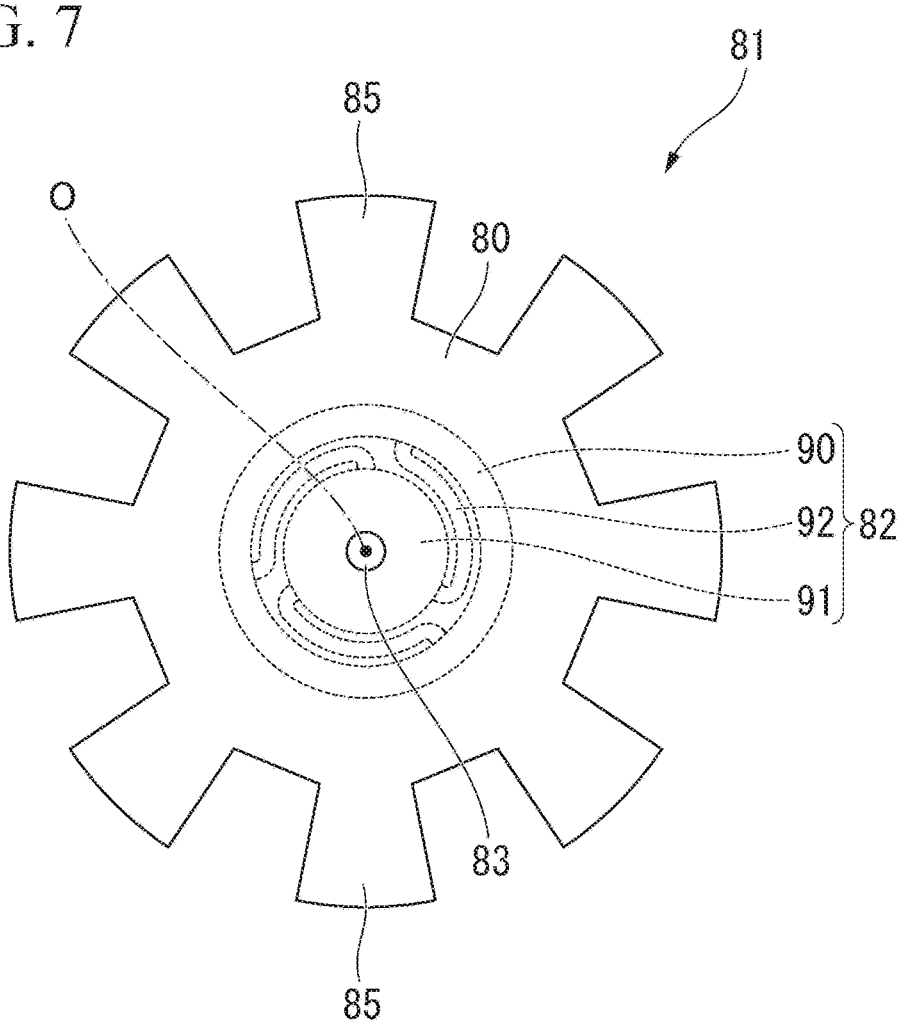
FIG. 7 is a top view of a diffusion unit shown in FIG. 1.

As shown in FIGS. 1 and 7, the diffusion unit 81 includes a valve body 82 internally attached to the recess portion 56 of the inner plate main body 50, a diffusion sheet 80 superimposed on the upper surface side of the valve body 82 and coming into contact with the upper surface of the inner plate main body 50 so as to be separable therefrom, and a fixing portion 83 fixing the diffusion sheet 80 to the valve body 82. The diffusion unit 81 diffuses the contents discharged from the stem 3 outward in the radial direction through a gap between the diffusion sheet 80 and the upper surface of the inner plate main body 50.

The valve body 82 is a check valve which closes the communication hole 57 of the inner plate main body 50 so as to be openable, and which switches communication and non-communication between the inside of the stem 3 and the inside of the diffusion chamber 52. The valve body 82 includes an annular frame body 90 fitted into the annular recess portion 58, a valve main body 91 which closes the communication hole 57 by being seated on the bottom surface of the recess portion 56 from above, and an elastic connecting piece 92 which connects the frame body 90 and the valve main body 91 to each other in the radial direction and which elastically supports the valve main body 91.

The valve main body 91 is formed in a disk shape in a plan view which is located coaxially with the container axis O, and is located inside the frame body 90. The diameter of the valve main body 91 is larger than the diameter of the communication hole 57, and is smaller than the inner diameter of the frame body 90. In this manner, the valve main body 91 is configured to be capable of contacting with the bottom surface of the recess portion 56 so as to surround an opening circumferential edge of the communication hole 57 over the entire periphery.

In the central portion of the valve main body 91, a first connecting hole formed in a circular shape in a plan view is located coaxially with the container axis O.

The elastic connecting piece 92 is located inside an annular space defined between the frame body 90 and the valve main body 91. As shown in FIG. 7, three elastic connecting pieces 92 are located inside the annular space at an interval in the circumferential direction. In this manner, the valve body 82 is a so-called three-point valve in which the valve main body 91 is elastically supported by three elastic connecting pieces 92.

The number of the elastic connecting pieces 92 is not limited to three, and the valve body other than the three-point valve may be used.

The elastic connecting piece 92 extends along the circumferential direction. The inner end portion of the elastic connecting piece 92 is connected to the outer circumferential edge portion of the valve main body 91, and the outer end portion is connected to the inner circumferential surface of the frame body 90. In this manner, the elastic connecting piece 92 is elastically deformed in the upward-downward direction in accordance with the discharge pressure of the contents discharged from the stem 3, and supports the valve main body 91 so as to be movable upward from the bottom surface of the recess portion 56. Accordingly, the valve main body 91 can be elastically displaced in the upward-downward direction with respect to the bottom surface of the recess portion 56, and the communication hole 57 can be opened. In this manner, the inside of the stem 3 and the inside of the diffusion chamber 52 can communicate with each other, and the contents can be supplied into the diffusion chamber 52.

Figure 8:
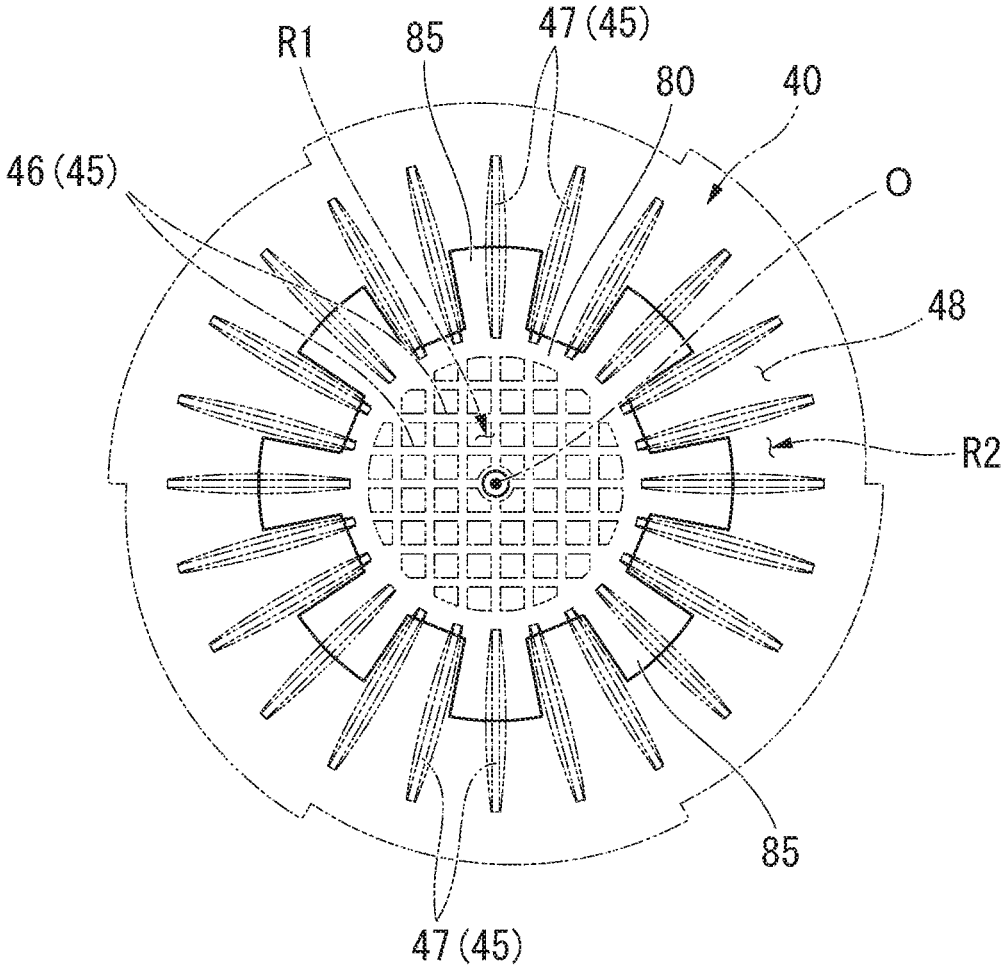
FIG. 8 is a plan view showing a positional relationship between a diffusion sheet shown in FIG. 1 and a central forming hole and an outer forming hole which are formed in a top wall portion.
Figure 9:
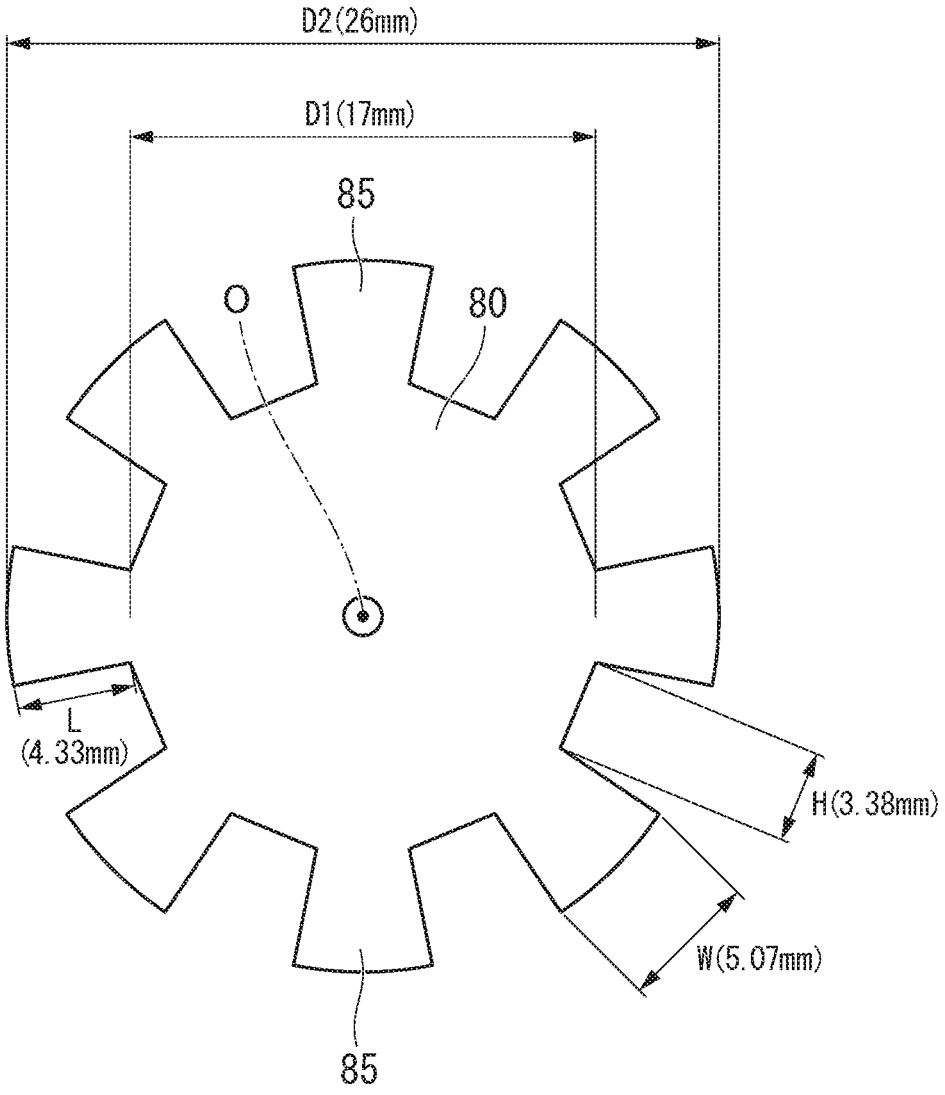
FIG. 9 is a plan view of the diffusion sheet shown in FIG. 8.

As shown in FIGS. 1, 8, and 9, for example, the diffusion sheet 80 is formed of a synthetic resin material or a rubber material into a thin sheet or film shape. Specifically, according to the present embodiment, the diffusion sheet 80 is a polyethylene terephthalate (PET) sheet having the thickness of 0.2 mm.

However, the thickness or the material of the diffusion sheet 80 is not limited to the above-described example. For example, as the material, other synthetic resin materials such as polypropylene (PP) and polyethylene (PE) or rubber materials such as elastomer rubber may be used. For example, the thickness may fall within a range of approximately 0.01 mm to 3 mm. For example, the thickness or the material of the diffusion sheet 80 can be appropriately changed and adjusted in accordance with the discharge pressure of the contents.

The diffusion sheet 80 is formed in a circular shape in a plan view so as to have a diameter D1 larger than the diameter of the central region R1 of the top wall portion 40 in a plan view when viewed in the direction of the container axis O. In this manner, the diffusion sheet 80 covers the plurality of central forming holes 46 formed in the central region R1 from below. Therefore, the outer circumferential edge portion of the diffusion sheet 80 is located outward in the radial direction from the recess portion 56 formed in the inner plate main body 50, and is seated on the upper surface of the inner plate main body 50 so as to be separable therefrom.

In the central portion of the diffusion sheet 80, a second connecting hole formed in a circular shape in a plan view is located coaxially with the container axis O. The second connecting hole is formed so that the inner diameter of the second connecting hole is the same as the inner diameter of the first connecting hole.

A diffusion piece 85 which projects outward in the radial direction is integrally formed in the outer circumferential edge portion of the diffusion sheet 80. A plurality of the diffusion pieces 85 are formed at an equal interval in the circumferential direction over the entire periphery of the diffusion sheet 80. In the shown example, the diffusion pieces 85 are formed as many as ⅓ of the number of the outer forming holes 47, and are formed so that the circumferential width along the circumferential direction is gradually widened outward in the radial direction.

A circumferential width (circumferential width of the most widened portion) W on the outer end portion side in the radial direction in the diffusion piece 85 has a size so that one diffusion piece 85 can overlap one outer forming hole 47 in the upward-downward direction in a plan view when viewed in the direction of the container axis O. A projecting length L along the radial direction of the diffusion piece 85 has a size so that the diffusion piece 85 can overlap the outer forming hole 47 in the upward-downward direction from the inner end portion throughout the central portion in the radial direction in the outer forming hole 47 in a plan view when viewed in the direction of the container axis O.

Then, the diffusion pieces 85 formed to have the above-described respective sizes are arranged at an interval H in the circumferential direction so that two outer forming holes 47 are arranged between the diffusion pieces 85 adjacent to each other in the circumferential direction.

Examples of the above-described respective sizes will be described as follows.

The diameter D1 of the diffusion sheet 80 is 17 mm. The projecting length L of the diffusion piece 85 is 4.33 mm. In this manner, a total diameter D2 including the diameter D1 of the diffusion sheet 80 and the projecting length L of the diffusion piece 85 is approximately 26 mm. In addition, the circumferential width W on the outer end portion side in the radial direction in the diffusion piece 85 is 5.07 mm, and the interval H between the diffusion pieces 85 adjacent to each other in the circumferential direction is 3.86 mm.

As shown in FIG. 1, the fixing portion 83 is fitted into the second connecting hole and the first connecting hole, and integrally connects the valve body 82 and the diffusion sheet 80 to each other. A portion of the fixing portion 83 which projects upward of the diffusion sheet 80 is configured to be capable of being contained inside the containing recess portion 44 formed in the top wall portion 40. Therefore, in a case where the inner plate 6 is located at the ascending end position P1, the supply surface 49 of the top wall portion 40 and the diffusion sheet 80 come into contact with each other without any gap.

However, it is not necessary to form the fixing portion 83 separately from the valve body 82 and the diffusion sheet 80. For example, the fixing portion 83 may be formed integrally with the valve body 82.

The diffusion sheet 80 is integrally fixed to the valve body 82. Accordingly, as shown in FIG. 4, when the contents are discharged from the stem 3, the diffusion sheet 80 moves upward as the valve main body 91 moves upward. In this manner, a gap for circulating the contents is formed between the diffusion sheet 80 and the upper surface of the inner plate main body 50. Furthermore, the thickness of the diffusion sheet 80 is thin. Accordingly, the diffusion sheet 80 is elastically deformable so that the outer circumferential edge portion side warps upward by using the discharge pressure of the contents. Therefore, similarly, the diffusion piece 85 is elastically deformable so as to warp upward.

(Use of Discharge Container)

Next, a case will be described where the contents are discharged using the discharge container 1 configured as described above.

In an initial state before the discharge container 1 is used, as shown in FIG. 1, the inner plate 6 is located at the ascending end position P1. Therefore, the valve main body 91 is seated on the bottom surface of the recess portion 56 so as to close the communication hole 57, and the diffusion sheet 80 is in contact with the upper surface of the inner plate main body 50.

In a case where the contents are discharged in this initial state, the exterior portion 5 is rotated around the container axis O in the second rotation direction M2 with respect to the container main body 10. In this case, the projecting rib 43 and the recess portion 61 engage with each other in the circumferential direction. Accordingly, the inner plate 6 can be rotated together with the exterior portion 5 in the second rotation direction M2, and the second inclined surface 71*b* of the sliding projection portion 71 can be brought into contact with the first inclined surface 72*b* of guide projection portion 72 in the circumferential direction. Then, if the exterior portion 5 and the inner plate 6 are further rotated in the second rotation direction M2, as shown by an arrow X1 in FIG. 6, the sliding projection portion 71 moves downward along the first inclined surface 72*b* of the guide projection portion 72.

In this manner, the inner plate 6 can be moved downward against a spring force (upward biasing force) of the coil spring 55. Therefore, as shown in FIG. 5, the diffusion chamber 52 can be formed between the top wall portion 40 and the inner plate main body 50, and it is possible to gradually increase a volume of the diffusion chamber 52. In addition, due to the downward movement of the inner plate 6, the locking portion 60 is locked to the opening end of the stem 3.

Therefore, as the inner plate 6 further moves downward, the stem 3 can be caused to descend against the spring force of the coil spring 55 and the upward biasing force of the stem 3 as shown in FIG. 4, and the contents can be discharged from the stem 3.

In this case, the contents press up the valve main body 91 from below. Accordingly, the valve main body 91 is moved upward by a pressing force acting from the contents (discharge pressure from the contents), and is separated from the bottom surface of the recess portion 56. In this manner, the elastic connecting piece 92 is elastically deformed in the upward-downward direction as the valve main body 91 moves upward. Then, the valve main body 91 is separated upward from the bottom surface of the recess portion 56, thereby opening the communication hole 57. Accordingly, the inside of the stem 3 and the inside of the diffusion chamber 52 can communicate with each other.

In this manner, for example, while the contents are diffused in the radial direction inside the diffusion chamber 52, the contents can be supplied to the central forming hole 46 and the outer forming hole. The contents can be discharged on the modeling surface 48 through the central forming holes 46 and the outer forming hole 47.

In this way, the contents are once diffused inside the diffusion chamber 52. Accordingly, for example, it is possible to prevent the contents from being concentrated only in a portion of the forming hole 45. In a state where the discharge amount of the contents less varies, the contents are likely to be discharged to the modeling surface 48 through the central forming hole 46 and the outer forming hole 47. Therefore, the contents can be discharged while the discharge amount of the contents discharged onto the modeling surface 48 is prevented from varying at the discharge position (varying in each of the forming holes 45).

In particular, the diffusion sheet 80 is located inside the diffusion chamber 52. Accordingly, a flow of the contents supplied from the stem 3 can be changed by the diffusion sheet 80, and the contents can be diffused outward in the radial direction through a gap between the upper surface of the inner plate main body 50 and the diffusion sheet 80. In this manner, the contents discharged from the stem 3 are caused to flow outward in the radial direction through the gap. Thereafter, while the contents are caused to ascend the diffusion sheet 80 so as to circulate around the diffusion sheet 80, the contents can be caused to flow inward in the radial direction from the outside in the radial direction inside.

In this way, the flow of the contents supplied from the stem 3 is changed by the diffusion sheet 80. In this manner, the contents can be prevented from linearly flowing from the stem 3 toward the central region R1 of the top wall portion 40 inside the diffusion chamber 52, and the contents can be diffused so that the contents evenly spread throughout the whole area inside the diffusion chamber 52. Therefore, the contents can be separately discharged in a state of preventing variations in the discharge amount of the contents flowing from the central forming hole 46 and the outer forming hole 47.

As a result, a modeled object having a sunflower shape can be finely formed on the modeling surface 48 with high accuracy and satisfactory reproducibility by using the contents discharged respectively from the central forming hole 46 and the outer forming hole 47.

In particular, according to the present embodiment, the plurality of central forming holes 46 are arranged in a lattice pattern in two directions in a plane of the top wall portion 40. Accordingly, the contents discharged through the central forming holes 46 are used. In this manner, the modeled object in which the modeled pieces are regularly arranged in the two directions, that is, the modeled object imitating sunflower seeds can be formed in the central region R1 on the modeling surface 48. Moreover, since the discharge amount of the contents is prevented from varying in each of the central forming holes 46, the respective modeled pieces can be brought into the same state. Therefore, it is possible to form an excellently designed modeled object in which the respective modeled pieces are beautifully and regularly arranged, and it is possible to beautifully produce the modeled object simulating sunflower seeds.

Since the slit-shaped outer forming holes 47 are radially arranged in the outer region R2, the modeled object simulating petals by using the contents discharged from these outer forming holes 47 can be formed so as to surround the modeled object simulating sunflower seeds.

As a result, on the modeling surface 48, the modeled object having an apparently beautiful sunflower shape can be formed with satisfactory reproducibility and high accuracy.

If the exterior portion 5 is further rotated in the second rotation direction M2, as shown by an arrow X2 in FIG. 6, the sliding projection portion 71 reaches the lower end portion on the first inclined surface 72*b* of the guide projection portion 72 and rides on the lower end portion in the circumferential direction so as to reach the clearance portion 75. In the clearance portion 75, the sliding projection portion 71 is allowed to move upward. Accordingly, as shown in FIG. 1, the inner plate 6 ascends to the ascending end position P1 by using an upward biasing force of the coil spring 55. In this manner, the stem 3 is unlocked from the locking portion 60, and the stem 3 moves upward. The discharge of the contents from the stem 3 is stopped, and the contents contained inside the diffusion chamber 52 are extruded onto the modeling surface 48 by the inner plate 6.

Further, the elastic connecting piece 92 is restored and deformed. Accordingly, the valve main body 91 moves downward, and is seated on the bottom surface of the recess portion 56. In this manner, the communication hole 57 can be closed again.

In a case where the contents are discharged again, the operation of rotating the exterior portion 5 in the second rotation direction M2 is repeatedly performed. In this manner, the above-described operation is repeatedly performed, thereby enabling the contents to be repeatedly discharged.

As described above, according to the discharge container 1 of the present embodiment, while the discharge amount of the contents is prevented from varying in each of the forming holes 45, the contents can be discharged onto the modeling surface 48. Therefore, the modeled object having the sunflower shape can be produced on the modeling surface 48.

In particular, when the contents are discharged from the stem 3, as shown in FIG. 4, the outer circumferential edge portion side of the diffusion sheet 80 is elastically deformed so as to warp upward, for example. Therefore, when the contents are caused to flow outward in the radial direction through the gap between the upper surface of the inner plate main body 50 and the diffusion sheet 80, a portion of the contents can be caused to positively circulate around the upper side of the diffusion sheet 80. In this manner, two flows can be mainly generated inside the diffusion chamber 52, such as a flow (flow of an arrow F1 shown in FIG. 4) of the contents from the above-described gap toward the central region R1 by way of the outer region R2 of the top wall portion 40 and a flow (flow of an arrow F2 shown in FIG. 4) of the contents from the above-described gap toward the central region R1 after positively circulating around the diffusion sheet 80.

Therefore, it is possible to effectively prevent the variations in the discharge amount of the contents discharged from the central forming hole 46 and the discharge amount of the contents discharged from the outer forming hole 47.

Furthermore, the diffusion piece 85 is formed in the outer circumferential edge portion of the diffusion sheet 80. Accordingly, a portion of the contents flowing outward in the radial direction through the gap between the upper surface of the inner plate main body 50 and the diffusion sheet 80 is caused to further flow outward in the radial direction along the diffusion piece 85. Thereafter, while the portion of the contents are caused to ascend so as to circulate around the diffusion piece 85, the portion of the contents can be caused to flow toward the outer forming hole 47. Therefore, the contents can be positively supplied to the outer forming hole 47, and it is easy to more effectively prevent the variations in the discharge amount of the contents.

Therefore, even when using the slit-shaped outer forming hole 47 extending in the radial direction, the contents can be evenly supplied throughout the whole outer forming hole 47.

According to the above-described configuration, the contents can be evenly supplied to each of the plurality of square-shaped central forming holes 46 aggregated and arranged in the central region R1 of the top wall portion 40 and the plurality of slit-shaped outer forming holes 47 radially arranged in the outer region R2 of the top wall portion 40.

Furthermore, in a case where the inner plate 6 is located at the ascending end position P1, as shown in FIG. 1, the valve main body 91 is seated on the bottom surface of the recess portion 56. In this manner, the communication hole 57 is closed, and the diffusion sheet 80 comes into contact with the upper surface of the inner plate main body 50 so as to block a gap between the inner plate main body 50 and the diffusion sheet 80. Therefore, for example, at the time of product distribution or storage, dust can be prevented from entering the stem 3, and operation reliability and quality can be improved.

In addition, while the inner plate 6 is caused to ascend from the descending end position P2 to the ascending end position P1, the contents contained inside the diffusion chamber 52 can be extruded onto the modeling surface 48 through the forming hole 45. Accordingly, the contents are less likely to remain inside the exterior portion 5. Therefore, it is easy to cleanly maintain the inside of the exterior portion 5.

In addition, an angle between the first vertical surface 72*a* and the first inclined surface 72*b* of the guide projection portion 72 an angle between the second vertical surface 71*a* and the second inclined surface 71*b* of the sliding projection portion 71 are equal to each other. Accordingly, it is possible to increase a contact area between the first inclined surface 72*b* and the second inclined surface 71*b* when the sliding projection portion 71 slides on the guide projection portion 72 in the circumferential direction. In this manner, for example, when the sliding projection portion 71 slides on the guide projection portion 72, the operation can be stabilized by preventing both of these from being worn.

In addition, the angles of the first inclined surface 72*b* and the second inclined surface 71*b* are equal to each other, and the plurality of guide projection portions 72 and the plurality of sliding projection portions 71 are disposed at an interval in the circumferential direction. Synergistically, the central axis of the inner plate 6 is prevented from being rotated in a state of being inclined with respect to the container axis O during the operation, and the inner plate 6 is smoothly rotated with respect to the container body 2 without being caught thereon.

In addition, both the guide projection portion 72 and the sliding projection portion 71 respectively have the vertical surfaces (the first vertical surface 72*a* and the second vertical surface 71*a*) extending in the upward-downward direction. Accordingly, as the rotation direction around the container axis O of the exterior portion 5 and the inner plate 6 with respect to the body 2, only the second rotation direction M2 can be allowed, and the sliding projection portion 71 reaching the clearance portion 75 can be quickly moved upward by using the upward biasing force of the coil spring 55.

In this manner, operability is improved when the exterior portion 5 is rotated with respect to the container body 2. Accuracy in modeling the modeled object can be more reliably improved by stabilizing the speed and the discharge amount of the contents discharged onto the modeling surface 48.

The technical scope of the present invention is not limited to the above-described embodiment, and various modifications can be made within the scope not departing from the gist of the present invention.

For example, in the above-described embodiment, the container main body 10 and the fixing member 11 are separately configured to serve as the container body 2. However, the container main body 10 and the fixing member 11 may be configured to be integrated with each other. In addition, the aerosol can is adopted as the discharge container main body 35. However, without being limited thereto, a configuration including the discharger having a pump mechanism can be adopted as the discharge container main body 35.

In addition, in the above-described embodiment, a case including the inner plate 6 has been described as an example. However, the inner plate 6 may not necessarily be provided.

In this case, a diffusion wall portion may be disposed inside the exterior portion 5. The diffusion wall portion is located to face the supply surface 49 of the top wall portion 40, and defines the diffusion chamber 52 from the supply surface 49. Moreover, an operating mechanism for causing the stem 3 to descend in accordance with the rotation of the exterior portion 5 may be provided.

In addition, in the above-described embodiment, the stem 3 is caused to descend by rotating the exterior portion 5 around the container axis O. However, the present invention is not limited to this case.

For example, a configuration may be adopted as follows. An operation member combined with the exterior portion 5 so as to be movable relative to each other may be provided, and the stem 3 may be caused to descend in accordance with the movement of the operation member with respect to the exterior portion 5.

In addition, as an alternative, for example, a configuration may be adopted as follows. An operation hole penetrating in the radial direction may be formed in the circumferential wall portion 41 of the exterior portion 5, and the inner plate 6 may have an operation piece projecting outward in the radial direction from the inner plate 6 and extending outward from the circumferential wall portion 41 through the operation hole. In this manner, the inner plate 6 can be caused to directly descend pressing down the operation piece.

In addition, in the above-described embodiment, the conversion mechanism 70 for converting the rotational operation around the container axis O of the inner plate 6 with respect to the container body 2 into the operation of the inner plate 6 in the upward-downward direction is disposed between the fixing member 11 and the inner plate 6. However, without being limited thereto, the conversion mechanism may be disposed between the exterior portion 5 and the inner plate 6.

In this case, the configuration of the projecting rib 43 and the recess portion 61 may be omitted, and the inner plate 6 may be supported so as to be movable upward and downward with respect to the fixing member 11. Even in a case of adopting this configuration, the inner plate 6 can be caused to descend by rotating the exterior portion 5 around the container axis O, and the stem 3 can be pressed down.

In addition, in the above-described embodiment, the diffusion sheet 80 and the valve body 82 are integrally combined with each other. However, the valve body 82 may not necessarily be provided. In this case, for example, the diffusion sheet 80 may be seated on the upper surface of the inner plate main body 50 so as to be separable therefrom, and the diffusion sheet 80 may be movable upward in accordance with the discharge pressure of the contents.

According to this configuration, only when the contents are discharged from the stem 3, the diffusion sheet 80 can be displaced upward, and the gap can be formed between the inner surface of the inner plate main body 50 and the diffusion sheet 80, thereby enabling the contents to pass through the gap.

The diffusion sheet 80 does not need to be seated on the upper surface of the inner plate main body 50, and may be separated from the upper surface of the inner plate main body 50. In this case, the gap through which the contents pass can be formed in advance between the upper surface of the inner plate main body 50 and the diffusion sheet 80. Therefore, even in this case, the same operation effect can be achieved.

Furthermore, in this case, the diffusion sheet 80 may not be displaced upward (including elastic deformation) by using the discharge pressure of the contents. However, for example, in a case where the outer circumferential edge portion of the diffusion sheet 80 is configured to be elastically deformable upward, the gap can be more preferably widened.

In addition, in the above-described embodiment, as shown in FIG. 9, the diameter D1 of the diffusion sheet 80 is set to 17 mm, the projecting length L of the diffusion piece 85 is set to 4.33 mm, the total diameter D2 including the diameter D1 of the diffusion sheet 80 and the projecting length L of the diffusion piece 85 is set to approximately 26 mm, the circumferential width W on the outer end portion side in the radial direction in the diffusion piece 85 is set to 5.07 mm, and the interval H between the diffusion pieces 85 adjacent to each other in the circumferential direction is set to 3.38 mm. However, these sizes may be appropriately changed.

In particular, in a case of the present embodiment, in order to produce the modeled object having the sunflower shape on the modeling surface 48, the central forming holes 46 having a square shape are aggregated in the central region R1 of the top wall portion 40 so as to form a lattice pattern, and the slit-shaped outer forming holes 47 are radially arranged in the outer region R2 of the top wall portion 40.

Therefore, in a case where the diffusion sheet 80 is not provided, the contents are more likely to be preferentially discharged from the central forming hole 46 close to the stem 3, compared to the outer forming hole 47. In addition, in the radial direction in the outer forming hole 47, the inner end portion of the outer forming hole 47 in the radial direction is closer to the stem 3. Accordingly, the contents tend to be preferentially discharged from the inner end portion of the outer forming hole 47 in the radial direction, compared to the outer end portion of the outer forming hole 47 in the radial direction.

In this regard, according to the present embodiment, the diffusion sheet 80 is provided. Accordingly, as described above, the contents can be prevented from directly flowing from the stem 3 toward the central region R1 of the top wall portion 40. Therefore, the contents can be caused to flow in a well-balanced manner toward the central region R1 and the outer region R2. In a state where the discharge amount of the contents is prevented from varying, the contents can be discharged from the central forming hole 46 and the outer forming hole 47.

Therefore, the diameter D1 of the diffusion sheet 80 greatly contributes to prevention of the variations in the discharge amount of the contents. That is, the discharge amount of the contents can be effectively adjusted in the well-balanced manner by adjusting the diameter D1 of the diffusion sheet 80.

Here, from a viewpoint of forming the modeled object with high accuracy on the modeling surface 48, depending on a shape and a mode of the modeled object, or position for forming the modeled object, in some cases, it may be necessary to adjust the balance of the discharge amount of the contents to be discharged from the central forming hole 46 and the outer forming hole 47. For example, it is conceivable to preferentially supply the contents to the outer forming hole 47 side so as to increase the discharge amount of the contents to be discharged from the outer forming hole 47.

Therefore, in this case, it is preferable to first adjust the diameter D1 of the diffusion sheet 80.

Then, if the projecting length L of the diffusion piece 85 is further lengthened, the contents are more likely to flow toward the outer end portion in the radial direction in the outer forming hole 47. On the other hand, the contents are less likely to flow toward the central region R1. In contrast, if the projecting length L is further shortened, the contents are less likely to flow toward the outer end portion in the radial direction in the outer forming hole 47. On the other hand, the contents are more likely to flow toward the central region R1.

Accordingly, in a case of adjusting the balance of the discharge amount of the contents discharged from the central forming hole 46 and the outer forming hole 47, it is preferable to adjust the total diameter D2 including the diameter D1 of the diffusion sheet 80 and the projecting length L of the diffusion piece 85, subsequently to the diameter D1 of the diffusion sheet 80.

It is preferable that the projecting length L of the diffusion piece 85 is set to a length which is approximately a half of the length of the outer forming hole 47, and a length to such an extent that the outer end portion of the diffusion piece 85 in the radial direction reaches the central portion of the outer forming hole 47 in the radial direction in a plan view when viewed in the direction of the container axis O.

For example, in a state where the outer forming hole 47 is formed in an arc shape in a plan view so as to extend in the circumferential direction, in a case where the outer forming holes 47 are arranged in a plurality of rows in the radial direction, it is preferable that the projecting length L of the diffusion piece 85 is set to an approximately half of the distance along the radial direction between the outer forming hole 47 located closest to the inner side in the radial direction and the outer forming hole 47 located closest to the outer side in the radial direction.

Next, the circumferential width W on outer end portion side in the radial direction in the diffusion piece 85 and the interval H between the diffusion pieces 85 adjacent to each other in the circumferential direction greatly contribute to the flow of the contents caused to further flow outward in the radial direction along the diffusion piece 85 after the contents flow to the outer circumferential edge portion of the diffusion sheet 80, and the flow of the contents caused to flow to the upper surface side of the diffusion sheet 80 so as to circulate around the diffusion sheet 80.

Therefore, in a case of adjusting the balance of the discharge amount of the contents discharged from the central forming hole 46 and the outer forming hole 47, it is preferable to finally adjust that the circumferential width W on the outer end portion side in the radial direction in the diffusion piece 85 and the interval H between the diffusion pieces 85 adjacent to each other in the circumferential direction.

Based on the above-described design concept, the diameter D1 of the diffusion sheet 80, the projecting length L of the diffusion piece 85, the total diameter D2 including the diameter D1 of the diffusion sheet 80 and the projecting length L of the diffusion piece 85, the circumferential width W on the outer end portion side in the radial direction in the diffusion piece 85, and the interval H between the diffusion pieces 85 adjacent to each other in the circumferential direction may be respectively changed. In this manner, the balance of the discharge amount of the contents discharged from the central forming hole 46 and the outer forming hole 47 can be adjusted, which can lead to preventing variations in the discharge amount of the contents.

Figure 10:
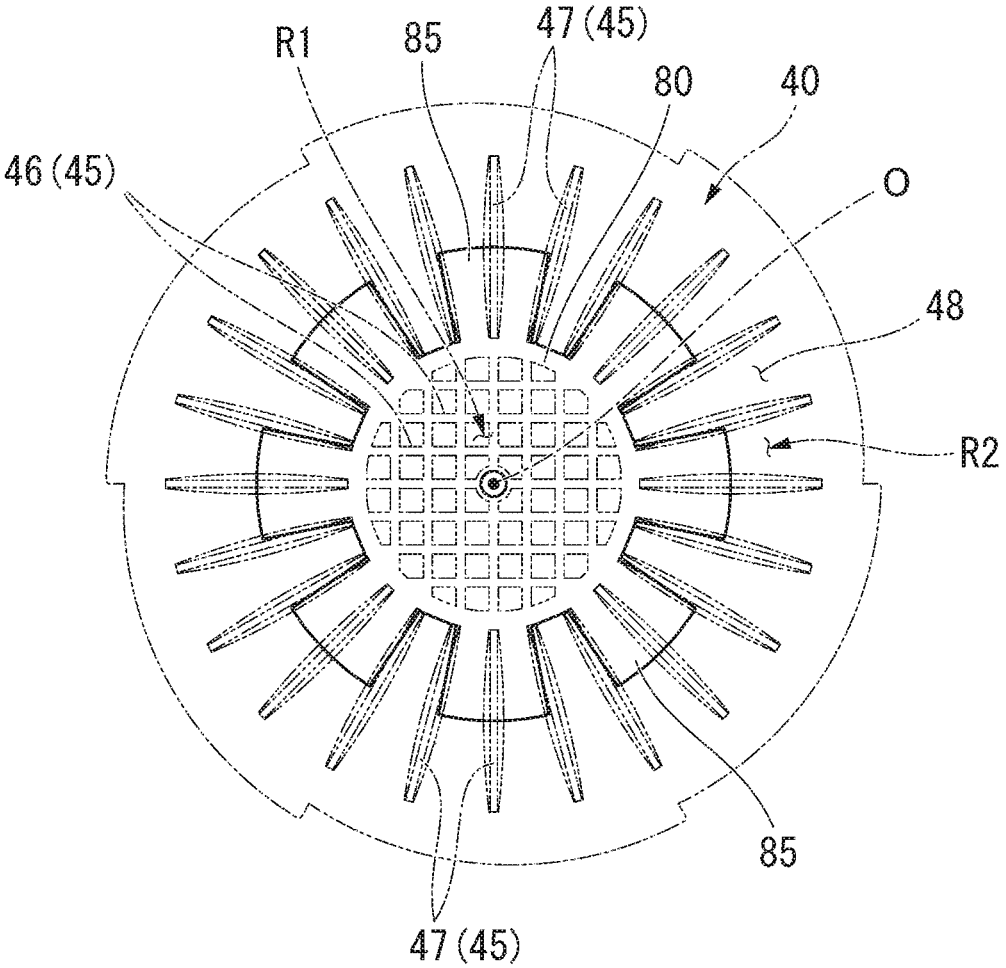
FIG. 10 is a view showing a modification example of the diffusion sheet, and is a plan view showing a positional relationship between the diffusion sheet and the central forming hole and the outer forming hole which are formed in the top wall portion.
Figure 11:
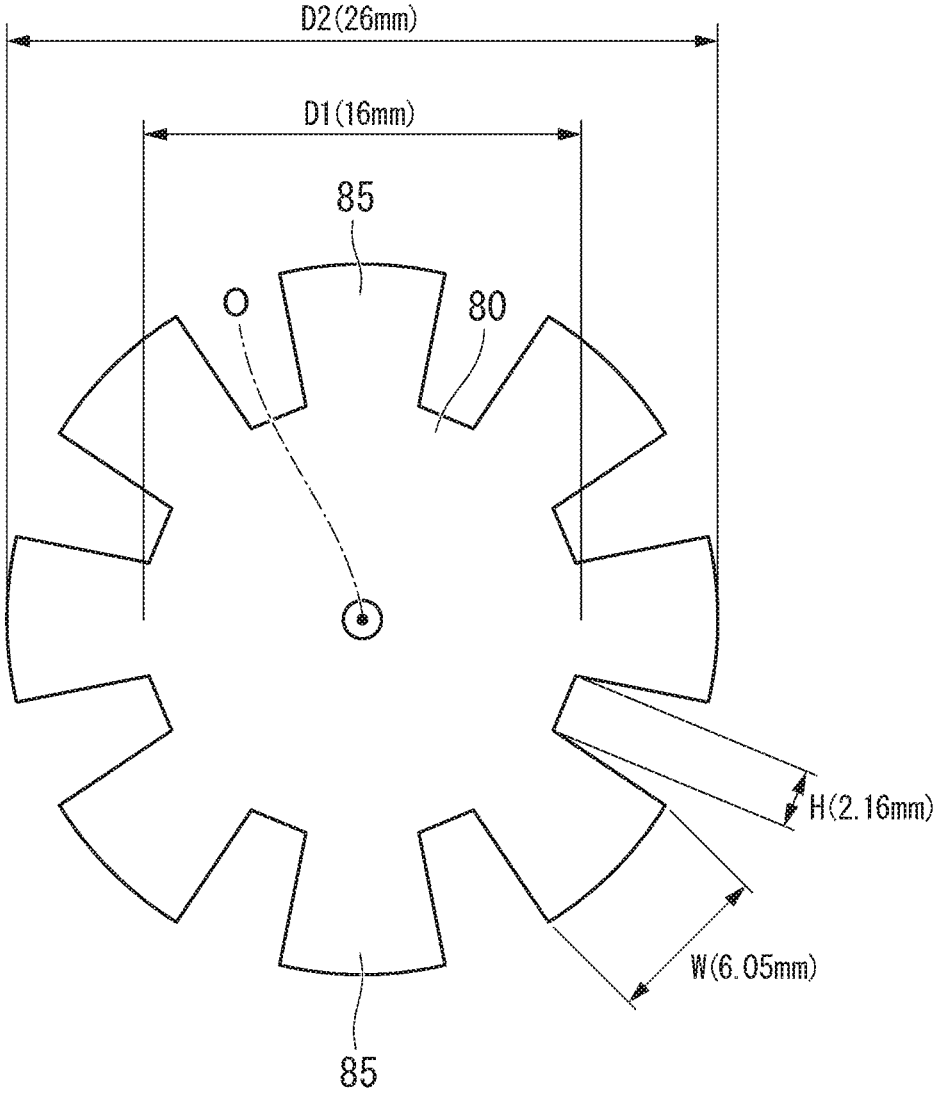
FIG. 11 is a plan view of the diffusion sheet shown in FIG. 10.

For example, as shown in FIGS. 10 and 11, the diameter D1 of the diffusion sheet 80 may be set to 16 mm, and the total diameter D2 including the diameter D1 of the diffusion sheet 80 and the projecting length L of the diffusion piece 85 may be set to approximately 26 mm. In this case, the diameter D1 of the diffusion sheet 80 is 1 mm smaller than that in a case shown in FIG. 9. Accordingly, the contents are more likely to flow toward the central region R1.

In this case, the circumferential width W on the outer end portion side in the radial direction in the diffusion piece 85 is set to 6.05 mm, and the interval H between the diffusion pieces 85 adjacent to each other in the circumferential direction is set to 2.16 mm. In this manner, it is possible to reduce a proportion of the contents which attempt to flow toward the central region R1, and it is possible to obtain the same operation effect as that according to the above-described embodiment.

Figure 12:
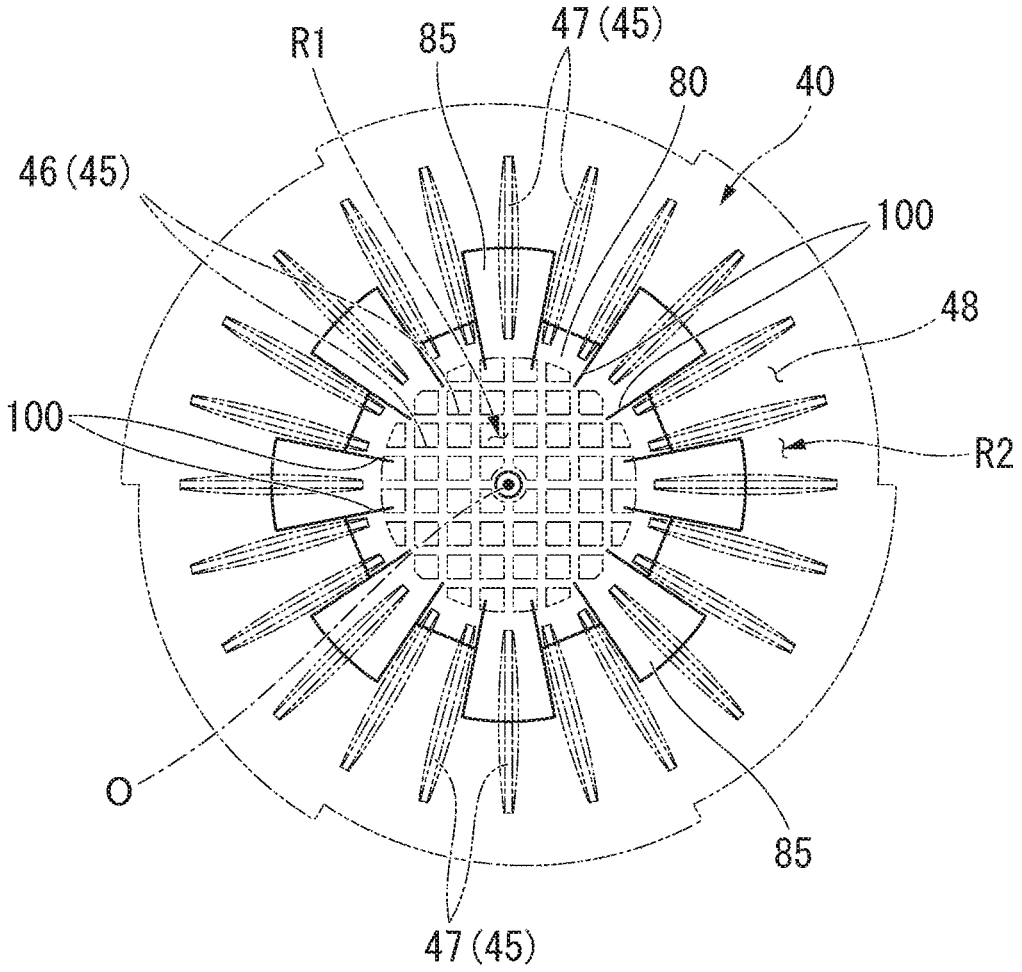
FIG. 12 is a view showing another modification example of the diffusion sheet, and is a plan view showing a positional relationship between the diffusion sheet and the central forming hole and the outer forming hole which are formed in the top wall portion.
Figure 13:
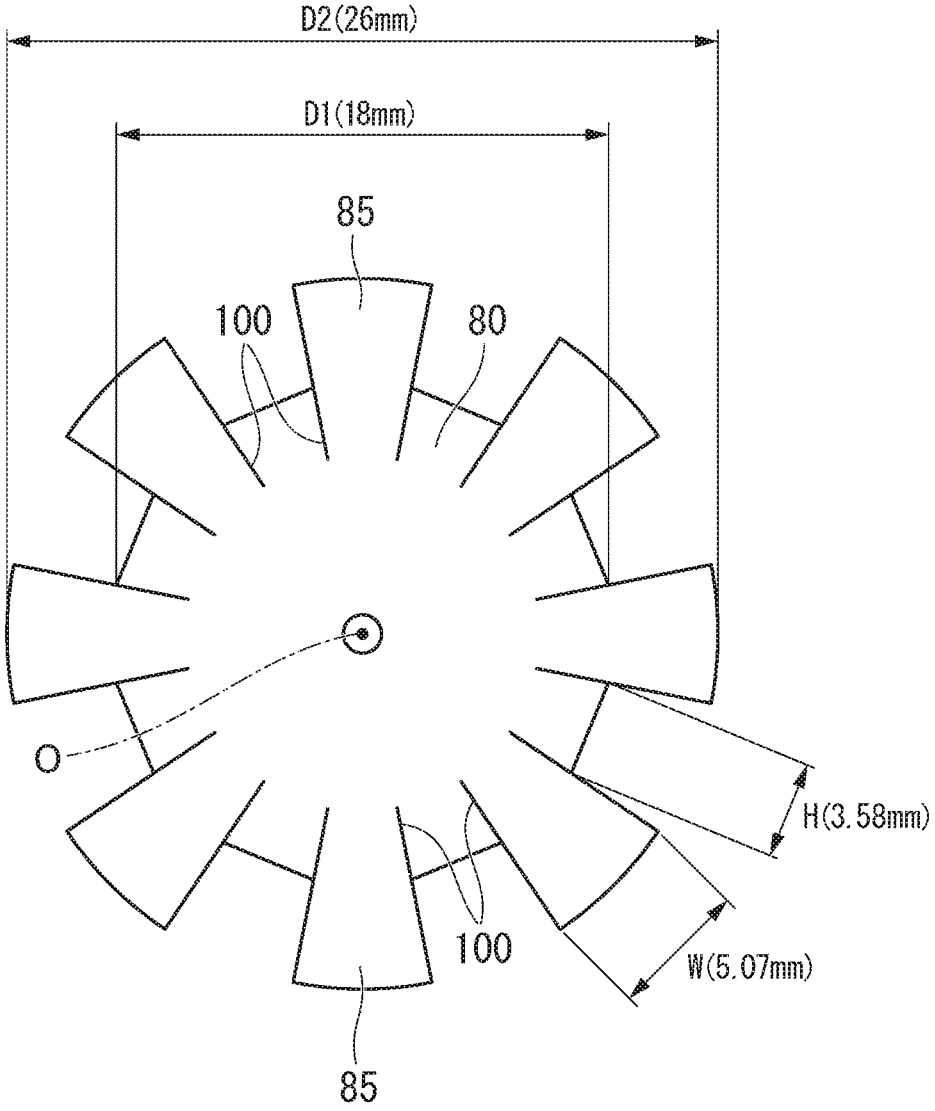
FIG. 13 is a plan view of the diffusion sheet shown in FIG. 12.

Furthermore, as shown in FIGS. 12 and 13, the diameter D1 of the diffusion sheet 80 may be set to 18 mm, and the total diameter D2 including the diameter D1 of the diffusion sheet 80 and the projecting length L of the diffusion piece 85 may be set to approximately 26 mm. In this case, the diameter D1 of the diffusion sheet 80 is 1 mm larger than that in the case shown in FIG. 9. Accordingly, the contents are less likely to flow toward the central region R1.

In this case, the circumferential width W on the outer end portion side in the radial direction in the diffusion piece 85 and the interval H between the diffusion pieces 85 adjacent to each other in the circumferential direction may be changed. However, in a case shown in FIGS. 12 and 13, the slits 100 are formed in the outer circumferential edge portion of the diffusion sheet 80.

The circumferential width W on the outer end portion side in the radial direction in the diffusion piece 85 is set to 5.07 mm, and the interval H between the diffusion pieces 85 adjacent to each other in the circumferential direction is set to 3.58 mm. There is no great difference from the case shown in FIG. 9.

The slit 100 is formed so as to extend inward in the radial direction from the portion located between the diffusion pieces 85 adjacent to each other in the circumferential direction, in the outer circumferential edge portion of the diffusion sheet 80, and the plurality of slits 100 are formed at an interval in the circumferential direction.

In this case, when the contents are discharged from the stem 3, the portion located between the slits 100 adjacent to each other in the circumferential direction in the outer circumferential edge portion of the diffusion sheet 80 is elastically deformed so as to face upward, for example, so as to warp upward. Therefore, out of the contents caused to flow outward in the radial direction through the gap between the upper surface of the inner plate main body 50 and the diffusion sheet 80, a portion of the contents other than the contents further flowing along the diffusion piece 85 can be positively circulated around the upper side of the diffusion sheet 80.

Therefore, even in a case where the diameter D1 of the diffusion sheet 80 is 1 mm larger than that in the case shown in FIG. 9, the contents can more easily flow toward the central region R1. Therefore, it is possible to obtain the same operation effect as that according to the above-described embodiment.

Figure 14:
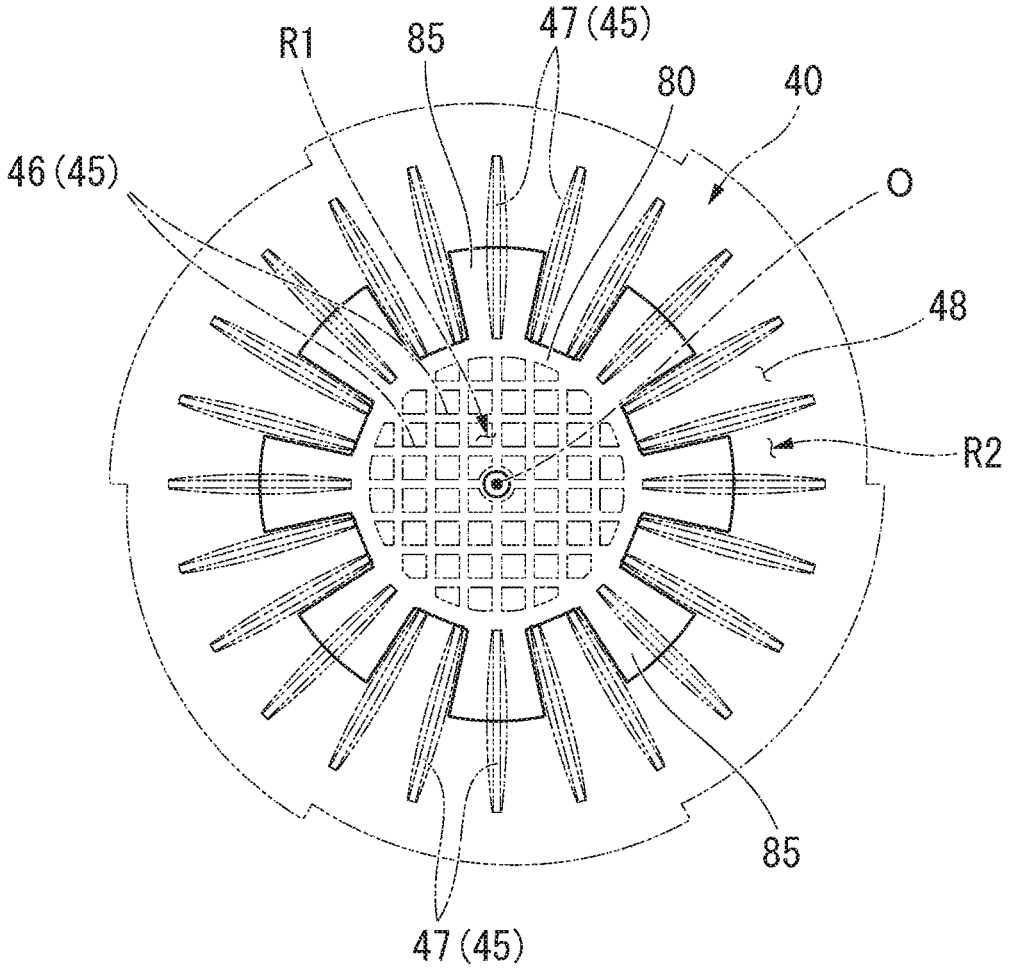
FIG. 14 is a view showing further another modification example of the diffusion sheet, and is a plan view showing a positional relationship between the diffusion sheet and the central forming hole and the outer forming hole which are formed in the top wall portion.
Figure 15:
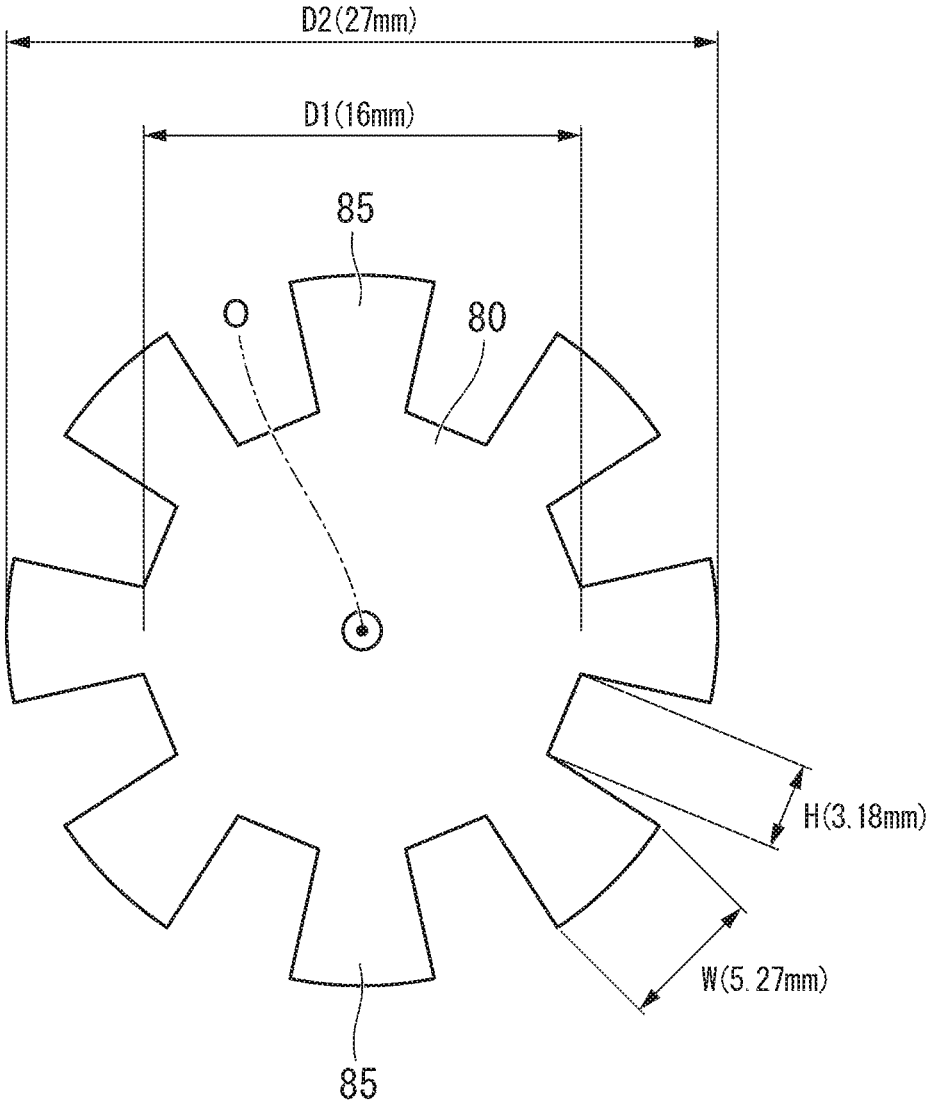
FIG. 15 is a plan view of the diffusion sheet shown in FIG. 14.

Furthermore, as shown in FIGS. 14 and 15, the diameter D1 of the diffusion sheet 80 may be set to 16 mm, the total diameter D2 including the diameter D1 of the diffusion sheet 80 and the projecting length L of the diffusion piece 85 may be set to approximately 27 mm, the circumferential width W on the outer end portion side in the radial direction in the diffusion piece 85 may be set to 5.27 mm, and the interval H between the diffusion pieces 85 adjacent to each other in the circumferential direction may be set to 3.18 mm.

In this case, the diameter D1 of the diffusion sheet 80 is 1 mm smaller than that in the case shown in FIG. 9. Accordingly, the contents are likely to flow toward the central region R1. Therefore, this configuration is effectively adopted in a case where the contents are more positively supplied to the central forming hole 46.

Furthermore, in the above-described embodiment, a case has been described where the diffusion piece 85 is formed in the diffusion sheet 80. However, the diffusion piece 85 may not necessarily be provided.

Figure 16:
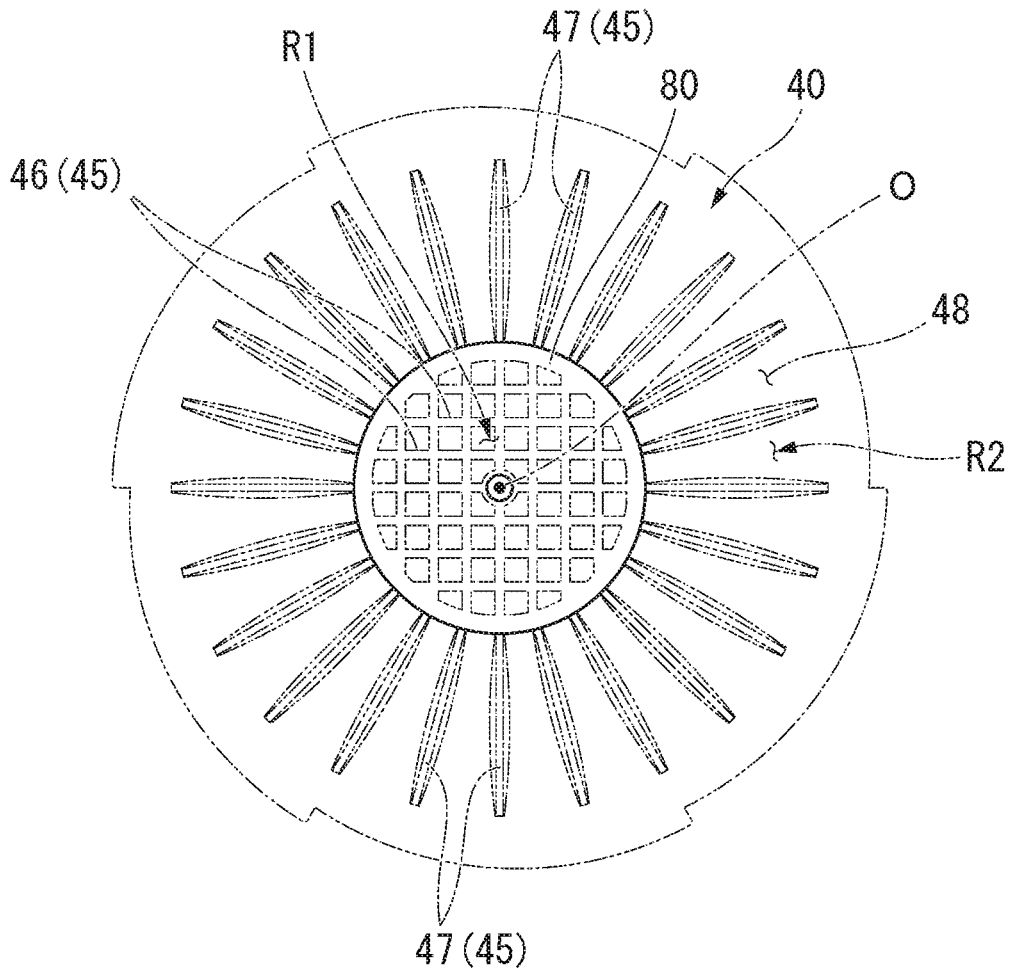
FIG. 16 is a view showing still another modification example of the diffusion sheet, and is a plan view showing a positional relationship between the diffusion sheet and the central forming hole and the outer forming hole which are formed in the top wall portion.

For example, as shown in FIG. 16, in a plan view when viewed in the direction of the container axis O in a state where the diffusion piece 85 is not provided, the diffusion sheet 80 may be located so as to overlap the whole region of the central region R1 of the top wall portion 40 in the upward-downward direction. As shown in FIG. 16, the diameter D1 of the diffusion sheet 80 is equal to the diameter of the central region R1.

Hitherto, the preferred embodiments according to the present invention have been described. However, the present invention is not limited to these embodiments and modification examples thereof. Additions, omissions, substitutions, and other modifications of the configurations can be made within a scope not departing from the gist of the present invention.

In addition, the present invention is not limited by the above description, and is limited only by the appended claims.

INDUSTRIAL APPLICABILITY

According to the discharge container of the above-described embodiments and the modification examples, the contents can be discharged while the discharge amount of the contents from varying at the discharge position. The modeled object can be formed in a desired mode with satisfactory reproducibility and high accuracy on the modeling surface by using the discharged contents.

REFERENCE SIGNS LIST

O: container axis
R1: central region of top wall portion
R2: outer region of top wall portion
1: discharge container
2: container body
3: stem
4: discharger
5: exterior portion
40: top wall portion
45: forming hole
46: central forming hole
47: outer forming hole
48: modeling surface
49: supply surface
50: inner plate main body (diffusion wall portion)
52: diffusion chamber
80: diffusion sheet (diffusion member)
85: diffusion piece
100: slit

What is claimed is:

1. A discharge container comprising:

a container body which contains contents;

a discharger which has a stem erected in a mouth portion of the container body so as to be movable downward in an upward force state;

an exterior portion which includes a top wall portion located above the stem and having a forming hole penetrating the top wall portion in an upward-downward direction, the exterior portion being configured to discharge the contents passing through the forming hole onto a modeling surface facing upward in the top wall portion; and a diffusion wall portion which is located inside the exterior portion, and that defines a diffusion chamber for supplying the contents from the stem to the forming hole, between the diffusion wall portion and a supply surface facing downward in the top wall portion, wherein:

the forming hole includes a central forming hole formed in a central region of the top wall portion, and an outer forming hole formed in an outer region located outward in a radial direction from the central region in the top wall portion, a diffusion member is provided in the diffusion chamber, the diffusion member is located so as to face the diffusion wall portion and is located so as to overlap a whole region of at least the central region in the top wall portion and the stem in the upward-downward direction, in a plan view when viewed in a container axis direction, the diffusion member is located so as to be movable upward by a discharge pressure of the contents from the stem, and the diffusion member is configured to diffuse the contents supplied from the stem outward in the radial direction through a gap between the diffusion member and the diffusion wall portion.

2. The discharge container according to claim 1, wherein an outer circumferential edge portion side of the diffusion member is elastically deformable upward by the discharge pressure of the contents from the stem.

3. The discharge container according to claim 1, wherein:

a diffusion piece which projects outward in the radial direction is formed in an outer circumferential edge portion of the diffusion member, and the diffusion piece is located so as to overlap the outer forming hole in the upward-downward direction, in a plan view when viewed in the container axis direction.

4. The discharge container according to claim 3, wherein:

a plurality of the outer forming holes are formed at an interval in a circumferential direction on an entire periphery of the top wall portion, and a plurality of the diffusion pieces are formed at an interval in the circumferential direction on an entire periphery of the diffusion member.

5. The discharge container according to claim 4, wherein:

a plurality of slits extending inward in the radial direction from a portion located between the diffusion pieces adjacent to each other in the circumferential direction is formed in the outer circumferential edge portion of the diffusion member, the slits being formed at an interval in the circumferential direction, and a portion located between the slits adjacent to each other in the circumferential direction, in the outer circumferential edge portion of the diffusion member is elastically deformable upward by the discharge pressure of the contents from the stem.

6. The discharge container according to claim 1, wherein a plurality of the central forming holes are formed at an interval in each of two directions orthogonal to each other in a plane of the top wall portion.

7. The discharge container according to claim 2, wherein:

a diffusion piece which projects outward in the radial direction is formed in an outer circumferential edge portion of the diffusion member, and the diffusion piece is located so as to overlap the outer forming hole in the upward-downward direction, in a plan view when viewed in the container axis direction.

8. The discharge container according to claim 7, wherein:

a plurality of the outer forming holes are formed at an interval in a circumferential direction on an entire periphery of the top wall portion, and a plurality of the diffusion pieces are formed at an interval in the circumferential direction on an entire periphery of the diffusion member.

9. The discharge container according to claim 8, wherein:

a plurality of slits extending inward in the radial direction from a portion located between the diffusion pieces adjacent to each other in the circumferential direction is formed in the outer circumferential edge portion of the diffusion member, the slits being formed at an interval in the circumferential direction, and a portion located between the slits adjacent to each other in the circumferential direction, in the outer circumferential edge portion of the diffusion member is elastically deformable upward by the discharge pressure of the contents from the stem.

10. The discharge container according to claim 2, wherein a plurality of the central forming holes are formed at an interval in each of two directions orthogonal to each other in a plane of the top wall portion.

11. The discharge container according to claim 3, wherein a plurality of the central forming holes are formed at an interval in each of two directions orthogonal to each other in a plane of the top wall portion.

12. The discharge container according to claim 4, wherein a plurality of the central forming holes are formed at an interval in each of two directions orthogonal to each other in a plane of the top wall portion.

13. The discharge container according to claim 5, wherein a plurality of the central forming holes are formed at an interval in each of two directions orthogonal to each other in a plane of the top wall portion.

* * * * *